US009582977B2

(12) United States Patent
Cowley et al.

(10) Patent No.: US 9,582,977 B2
(45) Date of Patent: Feb. 28, 2017

(54) SYSTEMS AND METHODS FOR MONITORING CONSUMPTION

(71) Applicant: Intel Corporation, Santa Clara, CA (US)

(72) Inventors: Nicholas P. Cowley, Wroughton (GB); Ruchir Saraswat, Swindon (GB); Colin L. Perry, Swindon (GB); Matthew T. Aitken, Swindon (GB); Richard J. Goldman, Cirencester (GB); Chi Man Kan, Swindon (GB)

(73) Assignee: Intel Corporation, Santa Clara, CA (US)

( * ) Notice: Subject to any disclaimer, the term of this patent is extended or adjusted under 35 U.S.C. 154(b) by 69 days.

(21) Appl. No.: 14/580,727

(22) Filed: Dec. 23, 2014

(65) Prior Publication Data

US 2016/0180679 A1 Jun. 23, 2016

(51) Int. Cl.

| | |
|---|---|
| ***G08B 23/00*** | (2006.01) |
| ***G08B 21/02*** | (2006.01) |
| *G08B 5/36* | (2006.01) |
| *G08B 3/10* | (2006.01) |

(52) U.S. Cl.

CPC ..... *G08B 21/02* (2013.01); *G08B 3/10* (2013.01); *G08B 5/36* (2013.01)

(58) Field of Classification Search

CPC .. A61B 5/6887; G09B 19/0092; G01N 33/02; G06Q 30/0635; G08B 21/02; G08B 5/36; G08B 3/10

See application file for complete search history.

(56) References Cited

U.S. PATENT DOCUMENTS

| | | | | |
|---|---|---|---|---|
| 8,446,283 | B2 * | 5/2013 | Pietrorazio | G01F 22/00 340/580 |
| 8,597,570 | B2 | 12/2013 | Terashima et al. | |
| 2003/0034895 | A1 * | 2/2003 | Reich | A01K 7/00 340/618 |
| 2006/0087831 | A1 * | 4/2006 | Kramer | A47G 19/025 362/101 |
| 2008/0162290 | A1 * | 7/2008 | Leifer | G06Q 10/06 705/15 |
| 2013/0157232 | A1 * | 6/2013 | Ehrenkranz | G01G 19/4146 434/127 |
| 2013/0203024 | A1 * | 8/2013 | Dekar | B25J 11/008 434/127 |

(Continued)

FOREIGN PATENT DOCUMENTS

| | | | |
|---|---|---|---|
| CN | 203802959 | U | 9/2014 |
| EP | 1772122 | A2 | 4/2007 |

(Continued)

OTHER PUBLICATIONS

International Search Report, PCT No. PCT/US2015/055143, mailed on Jan. 26, 2016, 4 pages.

(Continued)

*Primary Examiner* — Tesfaldet Bocure

(74) *Attorney, Agent, or Firm* — International IP Law Group, P.L.L.C.

(57) ABSTRACT

A method monitors the consumption of materials, including determining the presence of materials in a smart receptacle using a sensor located in the smart receptacle. A server is alerted when an actionable item is detected.

25 Claims, 19 Drawing Sheets

(56) References Cited

U.S. PATENT DOCUMENTS

| | | | | |
|---|---|---|---|---|
| 2014/0347491 | A1* | 11/2014 | Connor | A61B 5/1114 348/158 |
| 2014/0349683 | A1* | 11/2014 | D'Argenio | H04L 67/18 455/456.3 |
| 2015/0036555 | A1* | 2/2015 | Shin | H04L 5/0069 370/277 |
| 2015/0100621 | A1* | 4/2015 | Pan | H04L 67/06 709/203 |
| 2015/0245276 | A1* | 8/2015 | Lee | H04W 40/246 370/254 |
| 2015/0294450 | A1* | 10/2015 | Eyring | G02B 27/017 382/110 |
| 2015/0363092 | A1* | 12/2015 | Morton | G06F 3/04847 715/752 |
| 2015/0371317 | A1* | 12/2015 | Bosko | G06Q 30/0635 705/15 |
| 2016/0241997 | A1* | 8/2016 | Lucas | H04W 4/021 |

FOREIGN PATENT DOCUMENTS

| | | | |
|---|---|---|---|
| KR | 20080106992 | A | 12/2008 |
| KR | 20100108079 | A | 10/2010 |
| TW | 200823709 | A | 6/2008 |
| WO | 2013086372 | A1 | 6/2013 |

OTHER PUBLICATIONS

R.O.C. Search Report, R.O.C. Patent Application No. 104138586, completed on Dec. 14, 2016, 2 pages.

* cited by examiner

100

200

200

300

400

500

600

700

800

900

1000

1100

1200

1300

1400

1500

1600

1700

1800

1900

SYSTEMS AND METHODS FOR MONITORING CONSUMPTION

TECHNICAL FIELD

The present invention relates generally to devices for use in service networks. More specifically the present invention relates to devices that can be used to monitor consumption of foodstuffs.

BACKGROUND

Monitoring the consumption of materials, such as liquids and food, in commercial environments may be challenging in busy service environments, such as restaurants and hospitals. For example, in a food service environment, the replenishing of beverages and the presentation of bill are predominantly controlled by the efficiency of the waiting staff, either through passive monitoring of their covers, or by active request for service by the consumer. Accordingly, if consumption is not carefully monitored in a commercial environment, the revenue value of each consumer and the revenue associated with consumer throughput may be potentially negatively impacted by the ability to service consumers in a timely manner. This is particularly the case in high throughput establishments such as fast food restaurants or bars.

In health care environments, such as hospitals and long term care facilities, monitoring consumption of liquids, medicines, and food by patients may be very important to favorable outcomes. However, staffing constraints may make this challenging, possibly leading to oversights.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
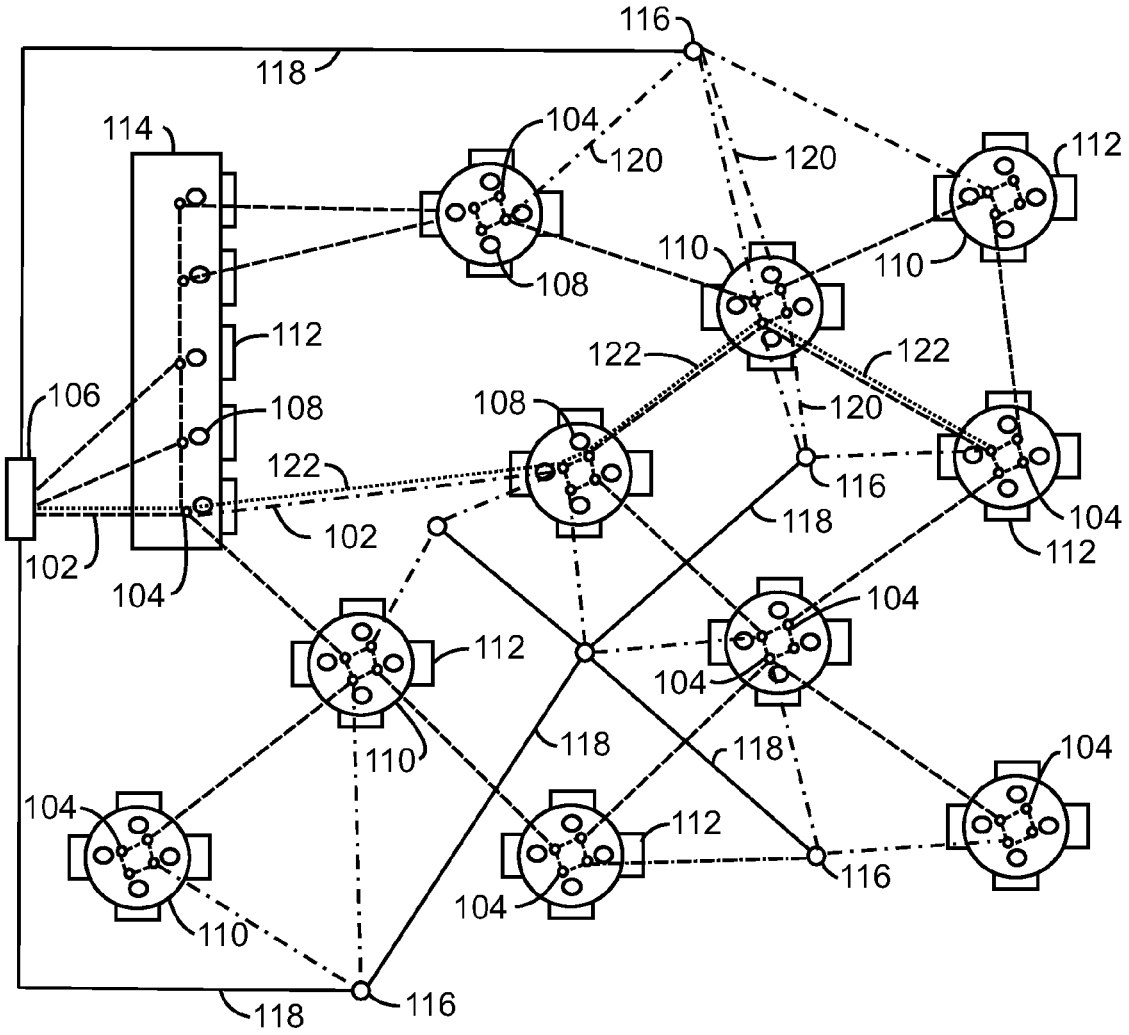
FIG. 1 is a drawing of a service environment, illustrating the formation of a local network between service containers, and a point-of-sale terminal.

The internet of things (IoT) is a concept in which a large number of computing devices are interconnected to each other and to the Internet to provide functionality and data acquisition at very low levels. For example, IoT networks may include commercial and home automation devices, such as light switches, thermostats, locks, cameras, alarms, motion sensors, and the like. Other devices may include sensors for health and fitness monitoring, such as pedometers and scales. These devices may be accessible through remote computers, smart phones, and other systems, for example, to control systems or access data.

Currently, beverage and other foodstuff receptacles are 'dumb' devices for containing and serving drinks and other foodstuffs. One embodiment described herein equips beverage and foodstuff receptacles with sensors and IoT connectivity which provides opportunity for multiple new applications and services such as e-commerce, improved user experience, improved medical monitoring, health monitoring, and the like. The systems to provide the IoT enablement may be embedded in the receptacle or as an attachable device. The IoT enabled containers are termed smart receptacles herein, and may include containers for liquids, such as glasses, mugs, intravenous fluid (IV) bags, surgical drainage units, urine containers, and the like. smart receptacles may also include containers for solids, such as plates, baskets, platters, solid medicines, and the like.

Information may be collected from the smart receptacle in a unidirectional fashion, such as a simple monitoring of consumption status. For example, in a food service environment, the system may be used to provide feedback on consumption to the server to allow for more timely and efficient service. This is beneficial for the consumer since they do not have to wait an undesirable length of time for their beverage to be refreshed or the bill presented. This is also beneficial for the business since it minimizes the 'dead' or non-revenue generating time of a consumer while they wait for a beverage to be replenished or the bill to be presented, which may decrease the time before a new consumer is served. It may also allow for cost reduction in the providing of consumer service, since a server can wait on tables in a more intelligent consumption based feedback directed manner. More timely contact with the server will also increase the average consumption per consumer. For example, a consumer is more likely to replenish their beverage if they do not have to wait.

In a hospital environment, the system may be used to track consumption of liquids by a patient. For example, the cups, glasses, and IV bags used to provide liquids to the patient may be smart receptacles. The system can be used to monitor net liquid gain or loss by a patient by equipping waste receptacles as smart receptacles. In addition to monitoring consumption, the system may provide a layer of protection on types of materials, for example, providing a warning if a patient is about to consume an allergen.

In one embodiment, detailed bidirectional information may be exchanged with the smart receptacle, for example, to provide indications of credit, balance, contents, and the like. Further, the smart receptacle may communicate with a service provider to display parameters such as calorie content, allergen risk, etc. The parameters may be displayed on the smart receptacle, or on a user's MID.

The smart receptacles may use either embedded or attached technologies. In either case, the smart receptacles are enabled with a capability to determine the presence or amounts of beverages, foodstuffs, or other materials such as medicines, wastes, and the like. Further, the smart receptacle may have connectivity to a local network, or to third party devices, such as a mobile internet device (MID) (including smartphones, and tablets), or a mobile internet device (MID) (including wearable monitors and health monitor in a body area network (BAN)).

The smart receptacle may include a means for downloading and storing information associated with the material contained and then passing to the third party device. The smart receptacle may be part of an overall consumption environment that includes a means for recording history of consumption and communicating with the cloud, among others. For example, an associated MID app can remember, or learn a consumers preferences or request further information, such as the name or vintage of a wine served in the smart receptacle. The smart receptacle may include a visual or audible communication device, such as a beacon, a sound generator, or a display.

The smart receptacle may connect with other IoT enabled devices, for example, to transport information from a first smart receptacle to a second, to provide audible or visual information, or to transfer information from associated sensors to an external IoT enabled device. In one embodiment, the smart receptacles may form an ad hoc network, in which packets are passed between smart receptacles to a central device. The central device may include a point of sale terminal, an ordering computer, or other system used to coordinate the operations of the service environment.

The smart receptacles may be used in a body area network (BAN), for example, in a hospital, nursing facility, or other health care environment. In this environment, the smart receptacles may be used to ensure that the patient is consuming the beverages and foodstuffs provided.

Any number of other devices may be used in an IoT network with the smart receptacle to provide the functionality described herein, including, for example, an IoT enabled device to download information to the smart receptacle, an IoT enabled device to receive information from the smart receptacle, and a network able to communicate with the device, among others. An establishment may include a system to determine the location of a smart receptacle, for example, based on Wi-Fi ToF (time of flight) or similar triangulation. This may be supplemented, or replaced, by a system that builds a map of IoT locations based on the path lengths, e.g., number of devices used for passing messages, between a smart receptacle and a central device. The central device may access a server or other services provider to store information, such as purchase records or preferences, or to access information, such as nutrition or allergen information.

FIG. 1 is a drawing of a service environment 100, illustrating the formation of a wireless network 102 between smart receptacles 104, and a point-of-sale terminal 106. In this example, the service environment 100 is a food service establishment. However, the service environment 100 could be a hospital, a long term care facility, or any number of other facilities, such as a lunchroom in an athletic training facility. The smart receptacles 104 in this example are only shown as beverage containers, although the plates 108 could also be equipped with devices to be smart receptacles 104. Other items are shown in the drawing to provide context, including, for example, tables 110, chairs 112, and a bar 114. It may be noted that, for simplicity, not every item is labeled. Further, only examples of all of the radio communication lines are shown for the ad-hoc network 102.

The central device 106 may be a point-of-sale terminal, an ordering terminal, or other device for tracking consumption. The central device 106 may have a centrally located receiver, or may have more localized receivers 116. The localized receivers 116 may be located, for example, on each table or serving a small group of tables. The internetworking protocol may allow for positional determination and tracking of a smart receptacle's location through knowledge of the cell associated with the receptacle. The localized receivers 116 may be tied in to the central device 106 through a wired network 118. Each of the smart receptacles 104 may communicate with a localized receiver 116 through a Wi-Fi or Bluetooth link 120.

In the case of a centrally located receiving device the transmission power required, for example, by the smart receptacles 104, may be disadvantageously higher than for a cell based mesh. However, in the case of centrally located receivers, triangulation, time-of-flight determinations, or other techniques may be deployed to determine location of a given receptacle. Triangulation may also be used with localized receivers 116, so long as the localized receivers 116 are selected to have some overlapping coverage.

The smart receptacles 104 themselves may be configured to establish a wireless network 102, such as an ad-hoc network. In an ad-hoc network, each of the smart receptacles 104 would participate by forwarding data to other smart receptacles 104. Any two smart receptacles 104 may communicate by relaying information through other smart receptacles 104. For example, the smart receptacles 104 may establish a route from any smart receptacle 104 to the central device 106, such as the path 122 coupling a smart receptacle 104 at the back of the service environment 100 to the central device 106.

Various routing protocols can be used in generating the wireless ad-hoc network 102 and maintaining the interconnections. For example, a technique termed, optimized link state routing (OLSR) protocol may be used to discover and disseminate link state information, which can be used to compute a shortest hop forwarding path between any smart receptacles 104 and the central device 106. The information used for the OLSR may also be used to create a map of the hops required to reach a destination, for example, a localized receiver 116. The map may be used with other techniques, or alone, to locate a smart receptacle 104.

In one embodiment, the internetworking protocol may allow for tracking of a smart receptacle 104 against an assigned account. This may be useful if a single account is used to pay for all of the smart receptacles 104 in a single cell of a mesh, e.g., all of the smart receptacles 104 accessed by a single localized receiver 116.

The service environment 100 shown in FIG. 1 is merely an example. In a restaurant environment, other vessels may be equipped as smart receptacles 104, such as plates 108, platters, serving trays, and the like.

Further, as described herein, other service environments may use the techniques described. For example, the service environment may be a ward or floor of a hospital. In this case, additional types of smart receptacles 104 may be deployed, such as urine collection vessels for urine, chest drainage units, or intravenous drip bags.

Figures 2A, 2B:
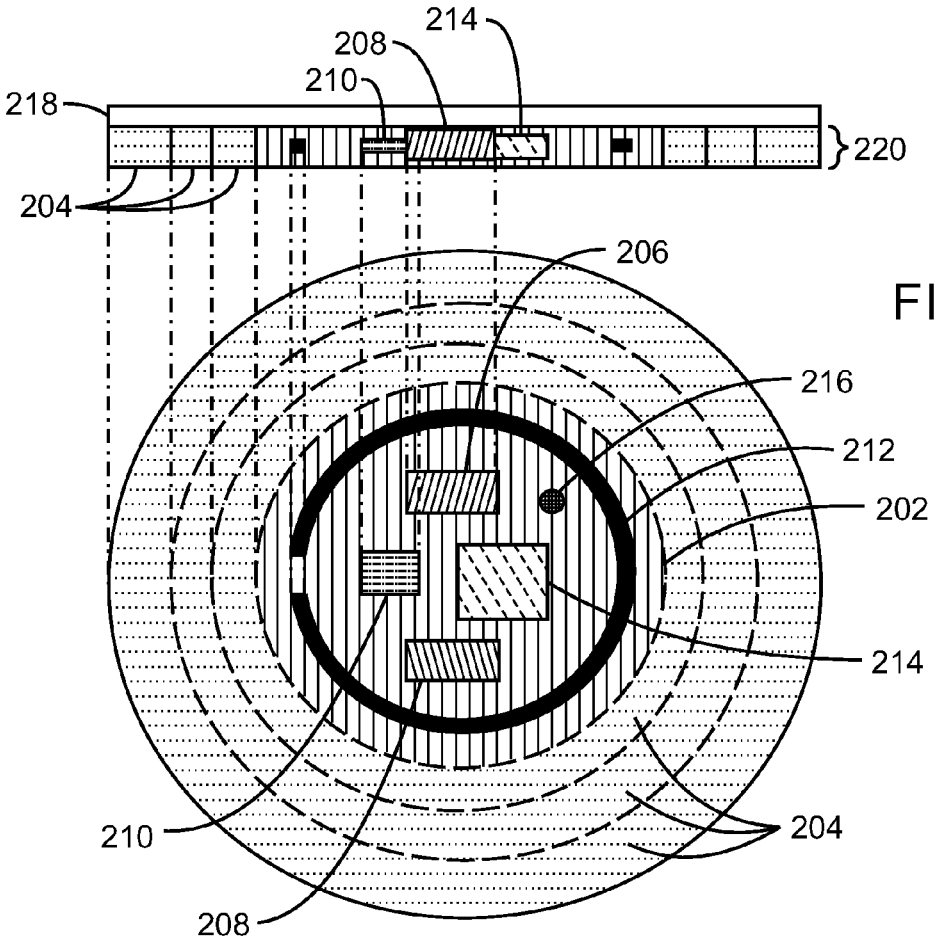
FIG. 2A is a top view of a device that can be attached to a service container to track consumption of materials from the service container.
FIG. 2B is a side cross sectional view of a device that can be attached to a service container to track consumption of materials from the service container.

FIG. 2A is a top view of a device 200 that can be attached to a service container to track consumption of materials from the service container. This may equip the service container to function as a smart receptacle 104, as described with respect to FIG. 1. The device 200 has a central core 202 that includes the functional components and which may be surrounded by press out formers 204. The press out formers 204 may assist in matching the diameter of the device 200 to a service container, for example, by being removed to make the diameter of the device smaller than that of the service container. However, these may not be used in other embodiments, for example, when the central core 202 is embedded in a service container.

The central core 202 may have a number of components to implement the functionality described herein. For example, the central core 202 may be equipped with one or more sensors 206 and 208 to determine the presence or amount of contents. A microcontroller 210, such as a system on a chip (SoC), may be used to obtain the measurement from the sensors 206 and 208 and send the measurement out over a wireless connection, for example, using an antenna 212.

The microcontroller 210 may be powered by an embedded battery 214. The battery 214 may be selected to last for the average life span of the service container, e.g., about 6 months to about 1 year. In one embodiment, the wireless antenna 212 may be used to charge the battery 214 in addition to providing a communications link. The selection of a charging mode versus a network mode may be determined by the presence of an alternating current (AC) charging field. A beacon 216 can be used to communicate from the service container, for example, by lighting or flashing to alert a server.

A number of technologies may be used for the sensors 206 and 208. For example, the sensors 206 and 208 may include two or more conductive surfaces on the inside of a service container. These may be located on the side of the service container near the base such that when the beverage is present an electrical circuit is maintained and when the beverage is consumed the electrical circuit is broken. The electrical signal may be DC or AC. The voltage associated would be set to avoid any sensation to the consumer, for example, below 100 mV.

The placement of the sensors 206 and 208 may be adjusted to increase the accuracy of the measurement. For example, the sensors 206 and 208 may be diametrically opposed to allow for tilting of the service container during consumption of the beverage. In one embodiment, each sensor may include two pads to maintain an electrical circuit. The software may also be written to account for changes having a short time constant, for example, delaying any alert until the circuit has been broken for a predetermined period of time, e.g., 15 seconds (s), 30 s, or 60 s. The sensors 206 and 208 may include two or more conductors that are located at different heights in the glass to provide information on the volume remaining. In one embodiment, the sensors 206 and 208 are placed on the base of the service container to detect an empty condition. In this embodiment, the service container may have a convex or concave base to allow any remaining residual liquid to flow away from conductor.

In one embodiment, the sensors 206 and 208 may include monitoring for a change in electrical conduction between the two elements of the sensor. The conductive surfaces of the sensors 206 and 208 may form part of a logo or other marking on the receptacle. The sensors 206 and 208 would be connected by appropriate conductive material within the structure of the receptacle to the controller.

The sensors 206 and 208 may use an electromagnetic (EM) field, such as through a spiral inductor embedded in the base of the service container. The EM field will be responsive to the presence of the contents of the service container. In one embodiment, a sensor 206 or 208 may be embedded in the side of the service container. The microcontroller 210 may provide stimulation to the sensors 206 and 208 which will provide a response that is dependent on the EM field. Detection of consumed condition may be through comparison with a pre-characterized empty state condition. As an interface with an external device may use radio frequencies, such as Wi-Fi, the antenna associated with the connectivity may provide some, or all, of the inductive sensing.

The sensors 206 and 208 may be responsive to pressure, for example, a pressure sensitive capacitor or a pressure sensitive resistor. A pressure sensor may be used to determine a load presented which will be directly proportional to the volume of content. For example, the device 200 may be calibrated to a given load with no beverage or foodstuff present. The consumption of the material, e.g., beverage or foodstuff, may be determined by the measured load substantially returning to the precalibrated value.

The sensors 206 and 208 may include a motion detector, for example, an optical sensor that detects light changes, among others. The sensors 206 and 208 may include a proximity detection which may be responsive to changes in objects that are in proximity to the device. In one embodiment, the device 200 may detect other devices in proximity and synchronize activities, such as flashing the beacons on all synchronized devices when one of the service containers is determined to be empty.

FIG. 2B is a side cross sectional view of the device 200. As shown in FIG. 2B, the central core 202 may be contained in an attachable device. For example, the attachable device may be disc shaped to match most service containers, e.g., cups, glasses, and plates. As described with respect to FIG. 2A, the device 200 may be supplied with press out formers 204 to assist in matching the diameter of the disc to the intended service container. Alternately, the device 200 may be supplied with a range of preformed ring shaped formers to optimize the diameter or non-circular formers to fit non-circular service containers. The device 200 may be attached to the service container through an affixing layer 218. The affixing layer 218 may be a hot melt adhesive, a cyanoacrylate adhesive, a polyurethane adhesive, or any number of other materials. The device may be hermetically sealed in an encapsulation 220 to prevent the infiltration of liquids. The encapsulation 220 and affixing layer 218 may be designed to be resistant to aggressive operating environments, for example, to allow washing of the service container with the attached device in a dishwasher.

The central core 202 does not have to be permanently mounted to the service container. In one embodiment, the central core 202 may be contained in an attachable device which can be fitted to an appropriate mounting point on a service container. This allows the central core 202 to be replaced without disposing of the service container. Further, the attachable central core 202 may be suitable for attachment to and removal from various types and form factors of dumb receptacles for different service environments.

The device 200 is not limited to the parts and attachments described with respect to FIGS. 2A and 2B, but may include other systems. For example, the device 200 is not limited to radio communications. In one embodiment, an optical link can be provided for communication between a device 200 on a smart receptacle, and a base station. In this embodiment, information concerning the contents, credit and the like, may be exchanged through a light emitting diode and phototransistor combination. This may occur when a smart receptacle is placed on a platform for refilling. The light communications may use the optical beacon 216, providing a visual effect for ambience and marketing purposes.

The device 200 may have a transducer to generate sounds, for example, warning beeps, or tones. For example, in medical or health applications the receptacle may be preprogrammed to give an audible warning if the rate of consumption is too low, or when content should be consumed. This may be a pure tone, a spoken message, or a haptic feedback, such as a vibration. In other embodiments, the communication may be instigated by a remote device or person.

In some embodiments, the device may include a microphone for detecting sounds. In these embodiments, the user may use voice inputs to the device 200. For example, an audible message may be triggered by the contents being consumed or nearly consumed, in which case the receptacle may ask if the user requires replenishment. The user may speak to the device 200, and thus, communicate back to the monitor or server.

Similar to the audible communication embodiments described above, the device 200 can be enabled with a visual communication means, such as the beacon 216. For example, in a medical application, this may supplement the audible warning with a visual warning. The device 200 may have a display for showing various information concerning contents or credits. For example, an e-ink display may be printed on the container to provide information on the product, to seek feedback on an order, or show progress on consumption.

Figure 3:
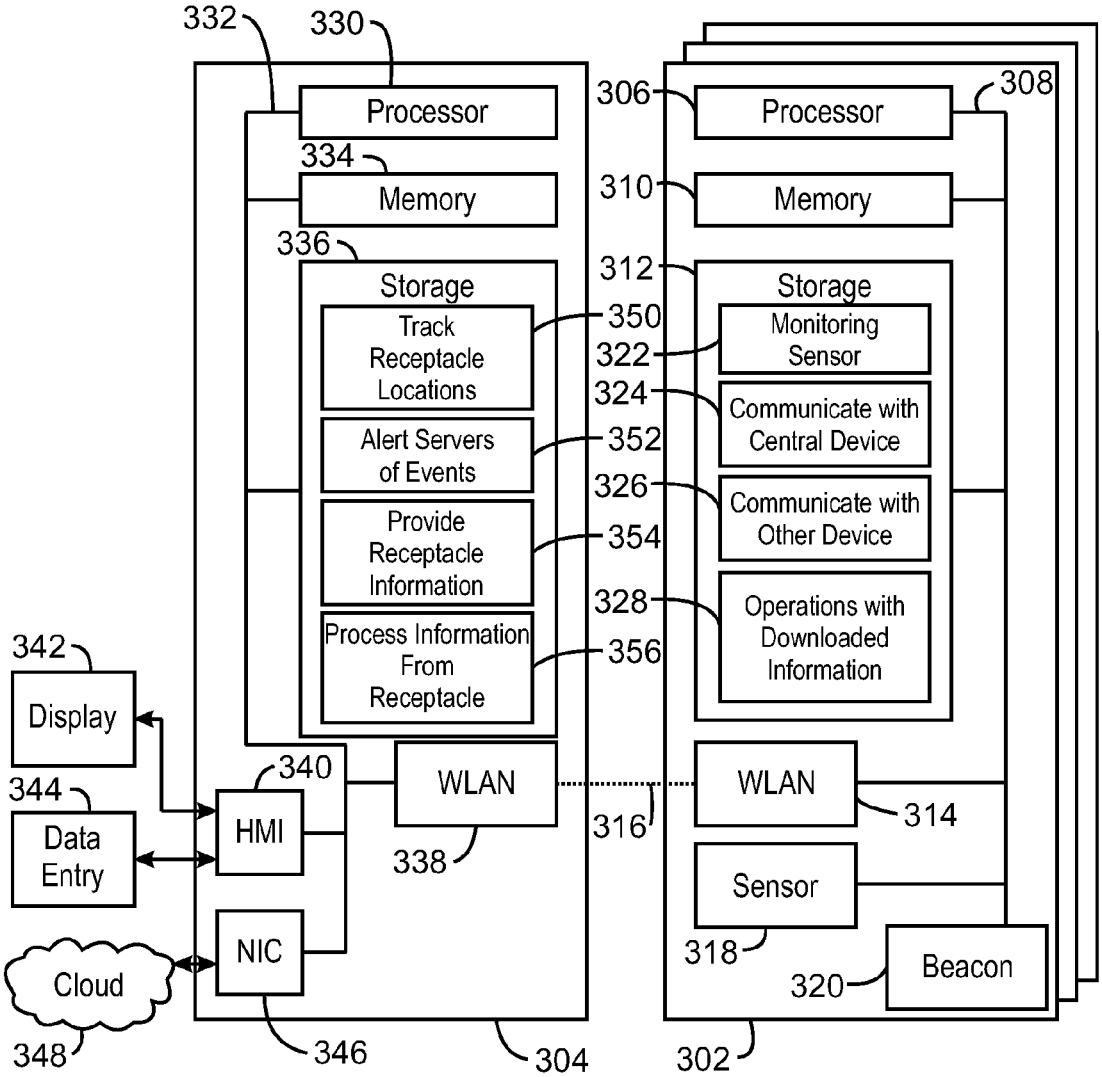
FIG. 3 is a block diagram of a system that can be used to measure consumption of materials from service containers.

FIG. 3 is a block diagram of a system 300 that can be used to measure consumption of materials from service containers. The system 300 includes one or more smart receptacles 302, such as the smart receptacles 104 described with respect to FIG. 1, and a central device 304, such as a point of sale terminal. The smart receptacles 302 may use a system on a chip (SoC) to simplify the design of the system 300. A SoC is a single integrated circuit that integrates all of the components needed for functionality. For example, the SoC may have a processor 306 coupled through a bus 308 to a memory 310. The memory 310 may be random access memory (RAM) used for storage of programs and data during operations. A storage device 312 may include read only memory (ROM), or other types of ROM such as electrically programmable ROM (EPROM), among others. The SoC may include a number of other functions, such as circuitry to provide a wireless local area network connection (WLAN) 314, which may also be termed Wi-Fi herein. The WLAN 314 may communicate with the central device 304 over a Wi-Fi connection 316.

The SoC may also include analog to digital convertors (ADCs) and digital to analog convertors (DACs) to drive a sensor 318 and a beacon 320. Other units may be present, such as a photodetector to work with the beacon 320 to form an optical communications link. A sound transducer may be included to provide alert signals, such as to alert a consumer to the presence of an allergen.

The storage device 312 is a non-transitory machine readable medium that may include a number of functional blocks to provide the functionality needed. For example, the storage device may include a sensor monitor block 322 to direct the processor 306 to control and monitor the sensor 318. A communications block 324 can provide the functionality to communicate with the central device 304. Another communications block 326 may provide the functionality to communicate with other devices, such as other smart receptacles 302, mobile internet devices (MID), dispensing terminals, and the like. An operations block 328 may include the instructions used to direct the processor 306 to implement other functions, such as presenting credits to a terminal, authorizing a refill of the smart receptacle 302, flashing the beacon 320 when empty, downloading data about the contents of the smart receptacle 302 from the central device, and uploading data to a MID, among others. Other functions that are not shown include various infrastructure functions, such as charging a battery, alerting a user to a low battery, and the like. Various other functions that may be included in the operations block 328 are described in the following process flow diagrams.

The central device 304 includes a processor 330 that communicates through a bus 332 with a memory 334. The central device 304 may use an SoC, or may use any number of other types of processors, including, for example, a single core chip, a multicore processor, a processor cluster, and the like. The bus 332 may include any number of bus technologies, such as a peripheral component interconnect express (PCIe) bus, a PCI bus, a proprietary bus, or any number of others. The memory 334 is used for short term storage of operating programs and results, and may include dynamic RAM, static RAM, or any number of other memory technologies.

The processor 330 may communicate with a storage device 336 over the bus. The storage device 336 may be used for longer term storage of program modules, e.g., functioning as a non-transitory machine readable medium. The storage device 336 may include a hard drive, an optical drive, a flash drive, or any number of other technologies.

A WLAN interface 338 may be used to communicate with the smart receptacles 302 over the Wi-Fi link 316. The communications may be between the central device 304 and individual smart receptacles 302, or as part of an ad-hoc network with a group of smart receptacles 302.

A human-machine interface (HMI) 340 may be used to couple the central device 304 to a display 342 and a data entry unit 344. The display 342 and data entry unit 344 may be integrated into a single touch screen unit, for example, in a point of sale terminal. Other systems may also be controlled by the HMI 340, such as a product dispenser, a cash drawer, a credit card reader, and the like. Further, the HMI 340 may be used to alert a staff member, for example, flashing a light to indicate that a location needs service.

A network interface controller (NIC) 346 may be used to connect the central device 304 to a computing cloud 348. The cloud 348 may include a local server network, an internal purchasing network, the Internet, and the like.

The storage device 336 can include a number of code blocks to provide functionality to the central device 304 in the system 300. For example, a tracking block 350 can locate individual smart receptacles 302 in the physical environment, for example, by using triangulation from Wi-Fi receivers, using local cells, using shortest hop paths in an ad-hoc network to create a predicted map of locations, or any combinations thereof. An alert block 352 may determine that an alert event, such as an empty smart receptacle 302, has occurred, and alerts a server that the smart receptacle 302 needs service. This can be done through the display, through a flashing the beacon 320 on the smart receptacle 302, or through a portable device worn by the server. An information block 354 may be used to provide information to the smart receptacle 302, such as content information, purchase information, and the like. A processing block 356 may be used to process information from the smart receptacle 302, such as payment information, total liquids consumed by a patient, purchase database information, and the like.

The system 300 is not limited to the devices or configurations shown. For example, remote receivers may be used to extend the range of the WLAN, as discussed with respect to FIG. 1. Further, the central device 304 may include an alert device to draw attention to an event, such as a flashing beacon or a transducer. Various other functions that may be included in the processing block 356 are described in the following process flow diagrams.

Figure 4:
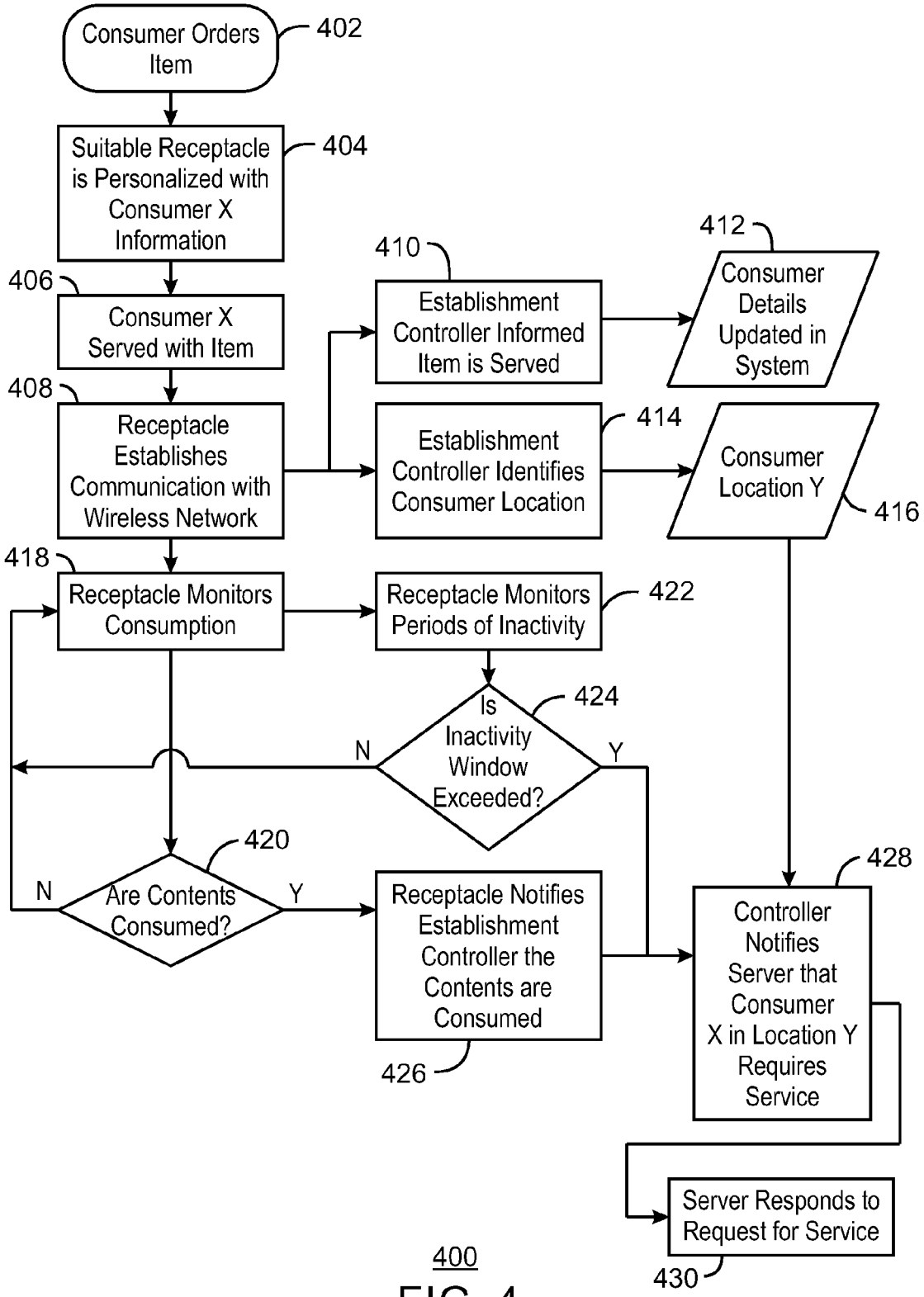
FIG. 4 is a process flow diagram of a method for improved consumer service and e-commerce.

FIG. 4 is a process flow diagram of a method 400 for improved consumer service and e-commerce. The method 400 begins at block 402 when a consumer orders an item. A server takes and processes the order. At block 404 a suitable smart receptacle is personalized with the consumer's information. For example, the smart receptacle may depend on the type of material ordered, and thus, the smart receptacle may be a cup, a beer glass, or a plate, among others, or any combinations thereof.

At block 406, the item is served to the consumer. At block 408, the smart receptacle establishes communications with the wireless network. This may be directly to a central device, to a remote receiver in a service cell, or through an ad-hoc network of smart receptacles. As part of establishing communications, at block 410, the establishment controller, e.g., the central device, is informed that the item has been served and at block 412, the consumer details are upgraded in the system. Further, at block 414 the establishment computer identifies the consumer location 416, for example, using the techniques described herein.

At block 418, the smart receptacle monitors consumption. At block 420, the smart receptacle determines if the contents have been consumed. If not, process flow continues at block 418. In addition, at block 422, the smart receptacle may monitor for periods of inactivity, indicating the consumer may have finished but has not completely consumed contents. If a predetermined activity window has not been exceeded at block 424, process flow continues at block 418.

If at block 420 the smart receptacle determines that the contents have been consumed, process flow proceeds to block 426 at which the smart receptacle notifies the establishment controller. At block 428, the establishment controller notify a server that the consumer at the consumer location 416 needs service. Further, if at block 424, a determination is made that an activity window has been exceeded, process flow also proceeds to block 428. At block 430, a server attends consumer and determines next course of action. For example, the server may offer another serving or may offer to bring the check.

The method 400 benefits the consumer since they do not have to wait an undesirable length of time for their beverage to be refreshed or the bill to be presented. The method is beneficial for the business since it minimizes the 'dead' non-revenue generating time of a consumer while they wait for a beverage to be replenished or the bill to be presented, decreasing the time to servicing a new consumer. It also potentially allows for cost reduction in the providing of consumer service since the server can wait on tables in a more intelligent consumption based feedback directed manner.

More timely contact with the server may also increase the average consumption per consumer. For example, a consumer is more likely to replenish their beverage if they do not have to wait. The method 400 enables discrete active monitoring of consumer consumption of beverages or foodstuffs and provides feedback to the server to provide more timely and efficient service.

Figure 5:
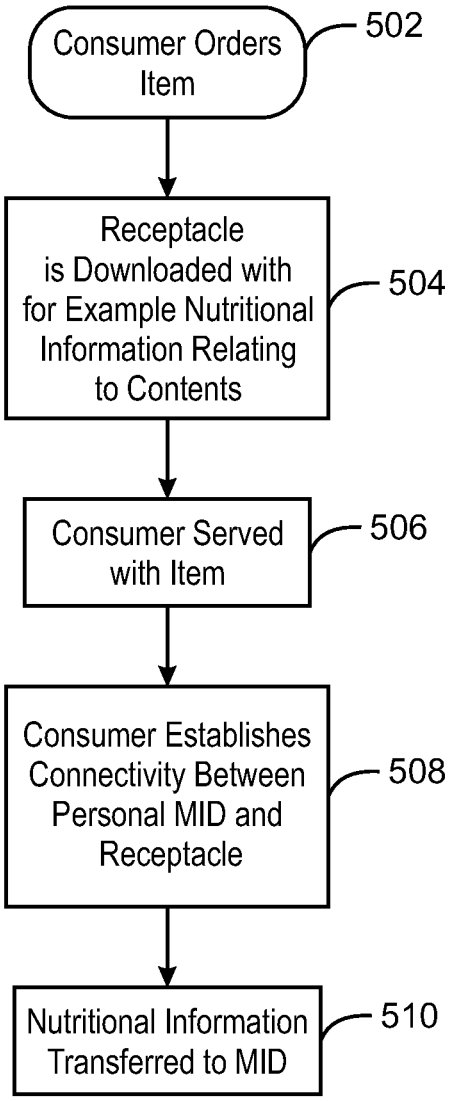
FIG. 5 is a process flow diagram of a method for monitoring nutritional information of receptacle contents.

FIG. 5 is a process flow diagram of a method 500 for monitoring nutritional information of the contents of a smart receptacle. The method 500 begins at block 502 when a consumer orders an item. At block 504, nutritional information for the item is downloaded into the smart receptacle. At block 506, the item is served to the consumer. At block 508, the consumer establishes connectivity between a personal MID and the smart receptacle. Establishing connectivity may be performed in any number of ways, such as bonding through a broadcast security beacon, which can use a secure password to instigate transfer either by the smart receptacle or the user's MID. Further, a code may be scanned on the receptacle, a 'bump and connect' pairing may be performed, or a Bluetooth link may be established, among others.

At block 510, the consumer transfers the nutritional information into the MID. This information can be used to, for example, monitor calorie intake, fat intake, sodium intake, and the like.

Figure 6:
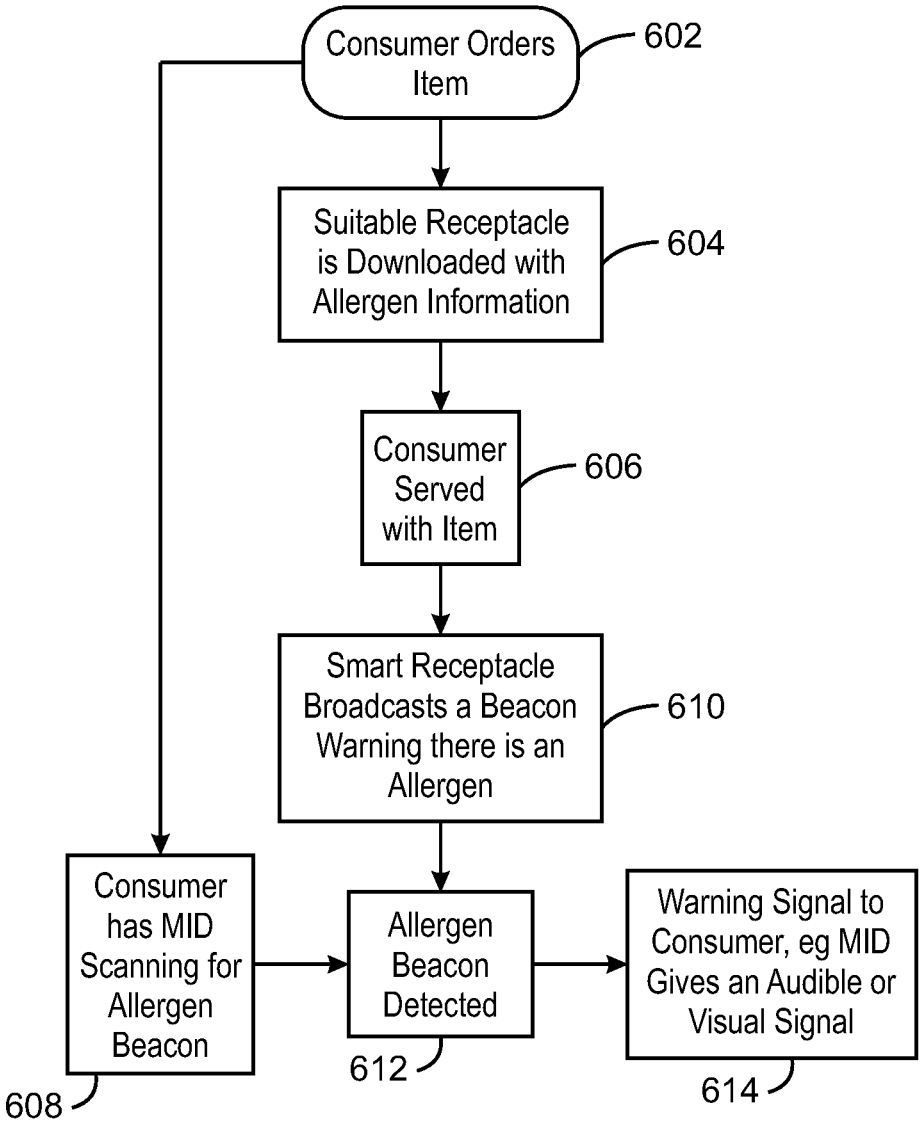
FIG. 6 is a process flow diagram of a method for monitoring for allergen presence in receptacle contents.

FIG. 6 is a process flow diagram of a method 600 for monitoring for allergens in the contents of the smart receptacle. Adverse reactions to drink and foodstuff allergens have become increasingly prevalent. The content of materials in a service environment can be difficult to determine, and hence, allergens can be accidentally ingested. Having to continually monitor and be aware of this condition can negatively impact a user experience, since there is the stress of determining what can be consumed and then the background worry that they may have missed something. The methods 600 and 700 described with respect to FIGS. 6 and 7 herein can reduce this risk and improve the consumer's experience and enjoyment. This is also advantageous in a social situation, for example, where the sufferer would like to sample another person's drink or dish. They can simply scan the dish's device for presence of allergen before sampling.

This invention in combination with an appropriate app on an MID would allow the sufferer to monitor their intake in a far more detailed and accurate manner than keeping a diary. The app will be able to keep a careful log of intake and enable the sufferer to enter their present state believed to be associated with a suspected allergen trigger. This would be supplemented by the app being able to read bar codes and by accessing an appropriate data base enabling other intake to be input. This would provide a history of input and a correlating response, to help diagnose the allergen trigger.

The method 600 begins at block 602 with a consumer ordering an item. At block 604 the allergen information for the item is downloaded into the smart receptacle. At block 606, the consumer is served the item. At block 608, the consumer will have their MID set to continually 'listen' for presence of allergen. At block 610, the smart receptacle broadcasts a warning beacon indicating an allergen or a specific allergen is present. At block 612, a warning beacon may be detected, for example, by the MID. At block 614, the consumer is given a warning signal, for example, from the MID. Further, the consumer's sensitivities may be provided to the receptacle wherein the warning signal may include a flashing of the beacon or an audible tone from the receptacle. To avoid false triggers the MID may be first paired with the smart receptacle by methods as described above.

Figure 7:
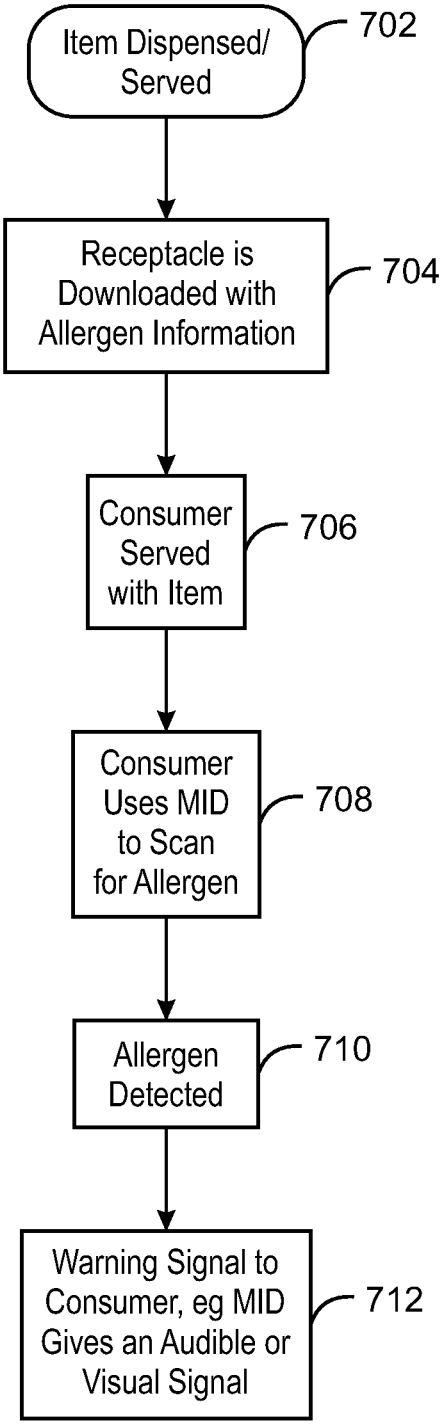
FIG. 7 is a process flow diagram of another method for monitoring for allergen presence in receptacle contents.

FIG. 7 is a process flow diagram of another method 700 for monitoring for allergen presence in receptacle contents. The method 700 begins at block 702 with an item being dispensed. At block 704, the smart receptacle containing the items is downloaded with allergen information. At block 706, the consumer is served with the item. At block 708, the consumer uses a MID to scan for an allergen, for example, by pairing the MID with the smart receptacle. At block 710, an allergen may be detected. If so, at block 712, a warning signal is provided to the consumer, for example, from the MID or from the smart receptacle. In this method 700 the beacons are only transmitted upon a request from a user's MID. This may be particularly useful in a social situation where people may try each other's items.

The methods 600 and 700 may also be applied to lifestyle choices or religious observance, for example, detecting presence of foodstuffs objectionable to vegetarians, vegans, or persons of various religions.

In environments such as hospitals, care homes, or person homes it can be problematic to monitor the amount of liquids or solids a patient is consuming. The techniques described herein provide an opportunity to actively monitor an individual's consumption by monitoring liquids or solids consumed from an enabled device or devices, such as the smart receptacle. The smart receptacle may monitor, store, and provide information on quantities consumed with time stamping. This information can be used for example to assess the user is remaining properly hydrated, properly nourished, and the like.

Figure 8:
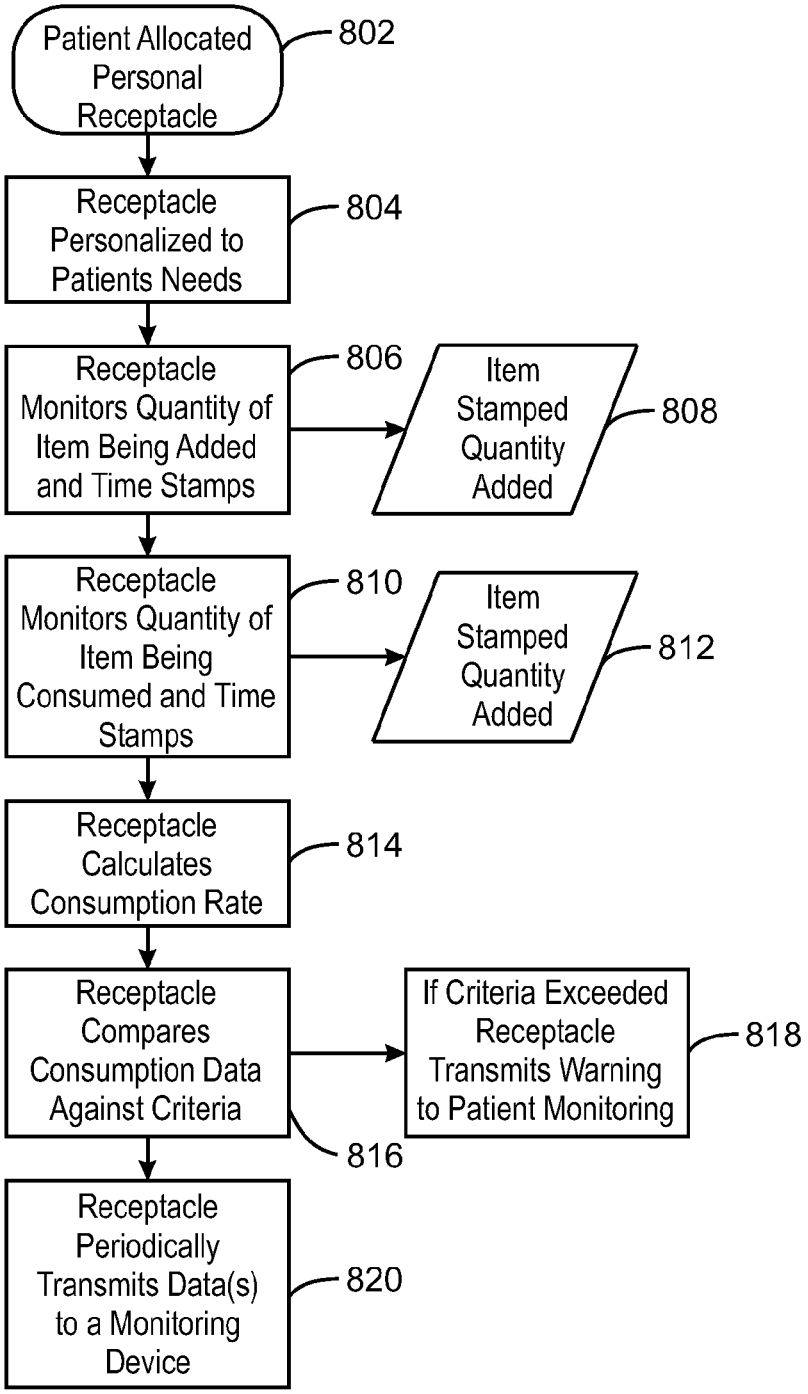
FIG. 8 is a process flow diagram of a method for using smart receptacles to monitor consumption in a medical environment.

FIG. 8 is a process flow diagram of a method 800 for using smart receptacles to monitor consumption in a home or medical environment. The method 800 begins at block 802 when a patient is provided with a personalized smart receptacle. At block 804, this may be downloaded with information such as the target patient intake of the item. At block 806, the smart receptacle monitors the quantity of the item added to the smart receptacle and records the item stamped quantity added 808. At block 810, the smart receptacle monitors the quantity consumed, and records the item stamped quantity added 812 of any further materials added.

While continuing to monitor consumption, at block 814, the smart receptacle calculates a consumption rate. At block 816, the smart receptacle compares the consumption rate, total amount, or other criteria against the target criteria. At block 818, if the criteria are exceed, such as if the intake falls below a target level, a warning signal is provided to a patient monitor, e.g., nurse or other health care provider. At block 820, the smart receptacle periodically transmits the consumption data to a monitoring device. The monitoring device may be an attachable device such as a cup holder, or may be a fixed device, such as a central monitor at a nurse's station. The method 800 may be used in combination with the methods 900 and 1000 described with respect to FIGS. 9 and 10 to provide a complete monitoring of nourishment consumed by a patient.

The method 800 may be used for domestic monitoring, for example, by pairing a smart receptacle with a MID, and transferring the information from the smart receptacle to the MID. In this example, the MID may function as the monitoring device, and transfer information and alerts to a health care provider. The MID may be used to scan a bar code of a product being consumed, download the contents, and then transfer this information to the smart receptacle. In some embodiments, the device will be able to determine the volume of materials consumed by weight and in other embodiments an estimation of the volume may be obtained from the downloaded content list. When a meal contains multiple contents this information can be gathered by the app, combined and then downloaded. Fresh ingredients information can also be similarly downloaded.

Figure 9:
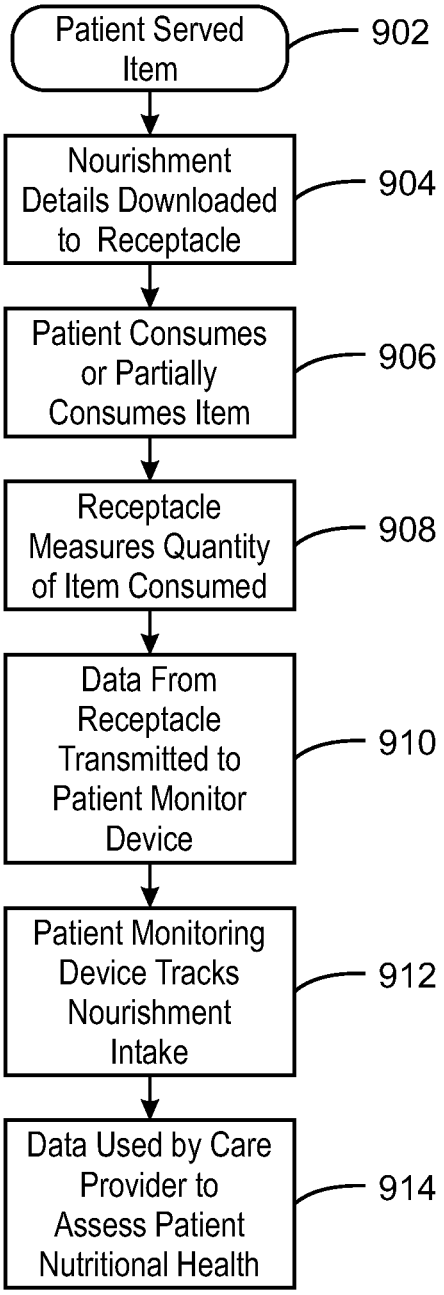
FIG. 9 is a process flow diagram of another method for using smart receptacles to monitor consumption in a medical environment.

FIG. 9 is a process flow diagram of another method 900 for using smart receptacles to monitor consumption in a medical environment. The method begins at block 902 when the patient is served an item. At block 904, nourishment details are downloaded to the smart receptacle. At block 906, the patient consumes or partially consumes the item. At block 908, the smart receptacle measures the quantity of the item consumed. At block 910, data from the smart receptacle is transmitted to a patient monitoring device. At block 912, the patient monitoring device tracks nourishment intake. At block 914, the data is used by a care provider to assess the patient's nutritional health.

The process is not limited to continuous communications. In some environments, the communications may be established when the smart receptacle is collected, for example, for refilling.

Figure 10:
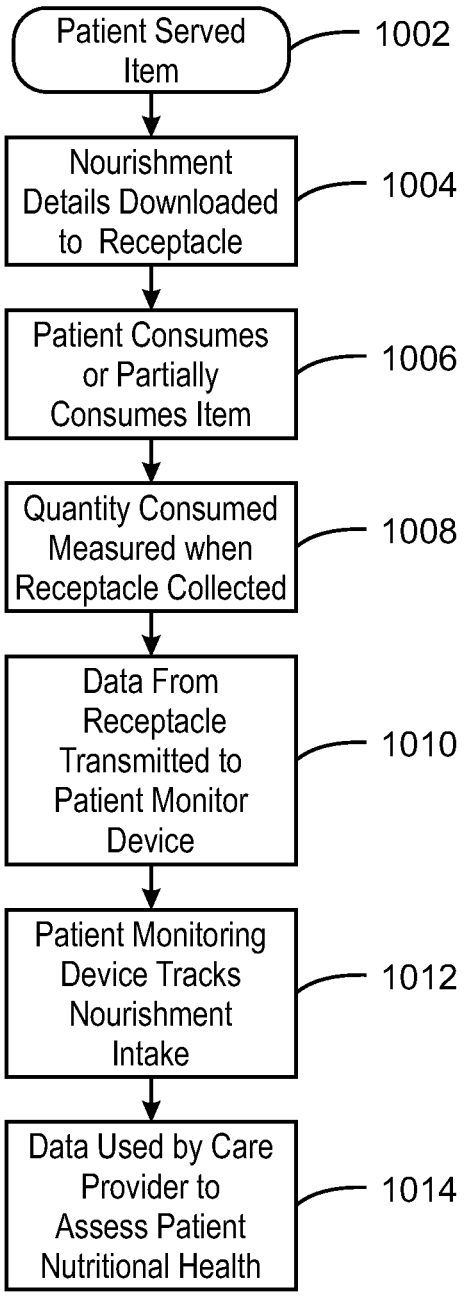
FIG. 10 is a process flow diagram of another method for using smart receptacles to monitor consumption in a medical environment.

FIG. 10 is a process flow diagram of another method 1000 for using smart receptacles to monitor consumption in a medical environment. The method begins at block 1002 when the patient is served an item. At block 1004, nourishment details are downloaded to the smart receptacle. At block 1006, the patient consumes or partially consumes the item. At block 1008, the smart receptacle measures the quantity of the item consumed when the device is collected. At block 1010, data from the smart receptacle is transmitted to a patient monitoring device. At block 1012, the patient monitoring device tracks nourishment intake. At block 1014, the data is used by a care provider to assess the patient's nutritional health.

The techniques described herein can be used to develop a data base of items consumed, for example, on the consumers MID. As the database is built the MID can be used to learn preferences for the consumer, for example, for certain dishes in a specific chain, for foods that contains certain ingredients, for wines form a specific region, and the like. The database will also allow access to history of items consumed in an establishment together with previous comments, for example, so that the consumer can avoid re-trying a poor meal.

Figure 11:
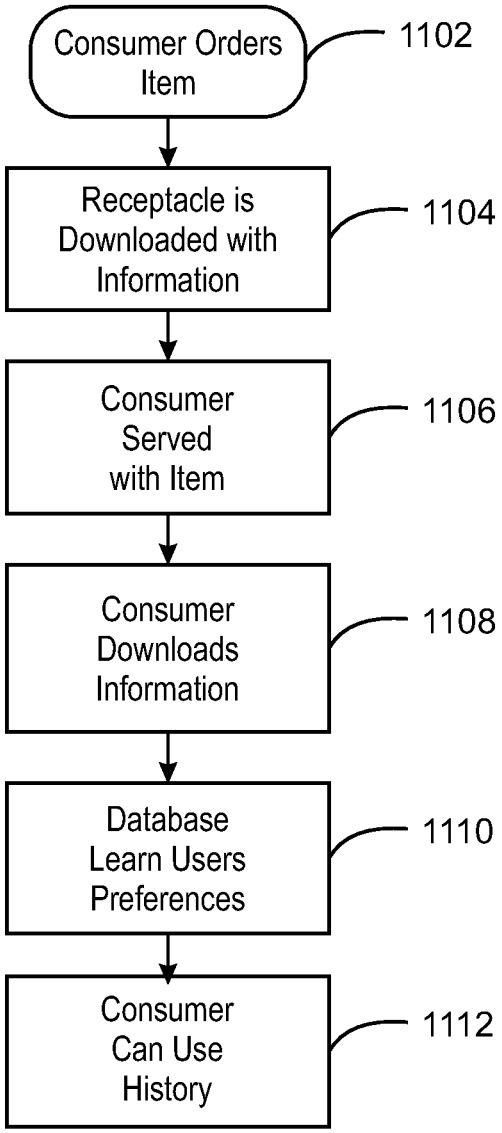
FIG. 11 is a process flow diagram of a method to use the smart receptacle to access information relating to for example the item contents, the name of the establishment, the provenance of the item, contents of accompanying dishes etc.

FIG. 11 is a process flow diagram of a method 1100 to use the smart receptacle to access information relating to an item. This information may include the item contents, the name of the establishment, the provenance of the item, contents of accompanying dishes. The method 1100 begins at block 1102, when a consumer orders an item. At block 1104, a smart receptacle is downloaded with information, for example, on the item, other information relating to accompanying items, and the establishment.

At block 1106, the consumer is served with the item. At block 1108, the consumer can download the information, for example, to a MID, along with comments and observations. At block 1110, a database is built of the user's preference, for example, on the MID. The database may include preferences by meal type, establishment, wine pairings, and the like. At block 1112, the consumer can use the history to aid purchase decisions, for example, by accessing the database on the MID.

In the method 1100 the consumer uses the smart receptacle to access information relating to the item, such as the item contents, the name of the establishment, the provenance of the item, contents of accompanying dishes, and the like. However, the techniques are not limited to single users, but may be used to learn preferences for groups of users.

Figure 12:
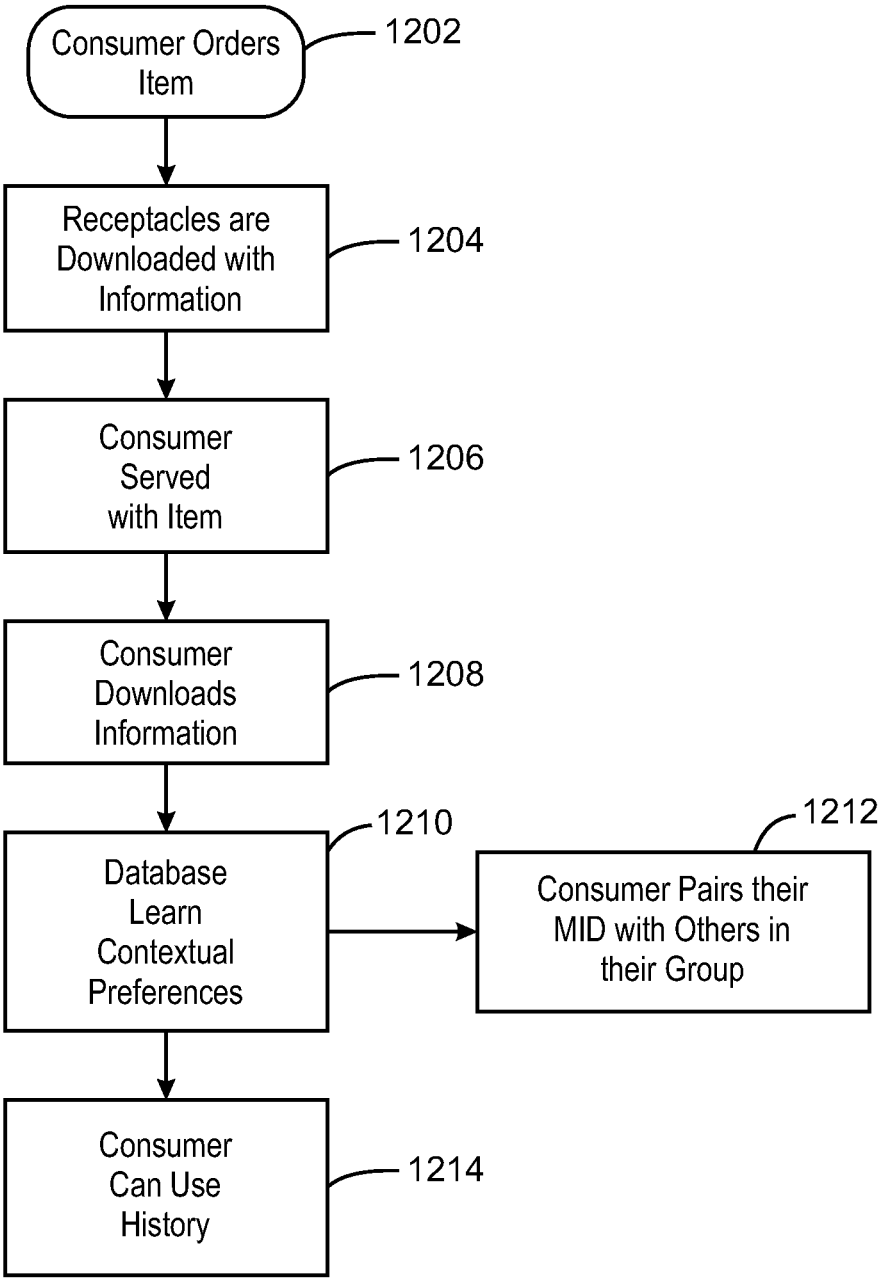
FIG. 12 is a process flow diagram of a method for using the smart receptacles to develop information on co-diners, by pairing MID devices of all individuals and sharing observations.

FIG. 12 is a process flow diagram of a method for using the smart receptacles to develop information for a group of users. This may be done by pairing the MID devices of all the individuals in the group and sharing observations.

This information may include the item contents, the name of the establishment, the provenance of the item, contents of accompanying dishes. The method 1200 begins at block 1202, when the consumers in a group order various items. At block 1204, the smart receptacles for the consumers are downloaded with information, for example, on the item, other information relating to accompanying items, and the establishment.

At block 1206, a consumer in the group is served with an item. At block 1208, the consumer can download the information, for example, to a MID, along with comments and observations. At block 1210, a database is built of the user's preference, for example, on the MID. The database may include preferences by social groups, meal type, establishment, wine pairings, and the like. At block 1212 the consumer can pair their MID with others in the group. Once paired, they can share information on likes, dislikes, and other information. At block 1214, the consumer can use the history to aid future dining decisions, for example, by accessing the database on the MID to get group preferences on dining establishments, types of food, individual preferences, and the like. This information can then be used to build a picture of preferences when consuming drinks or foodstuffs with different groups of friends or individuals.

Figure 13:
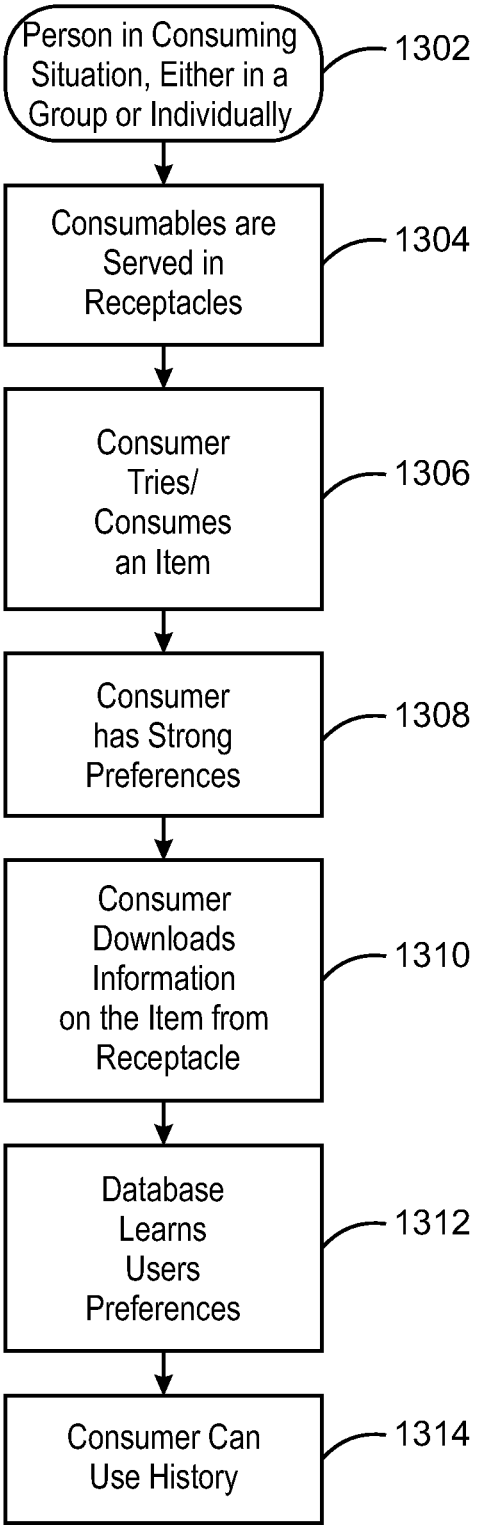
FIG. 13 is a process flow diagram of a method for using the smart receptacles to develop information on strong likes and dislikes.

FIG. 13 is a process flow diagram of a method for using the smart receptacles to develop information on strong likes and dislikes. This information may include the item contents, the name of the establishment, the provenance of the item, contents of accompanying dishes. The method 1300 begins at block 1302, with a person in a service environment. At block 1304, consumables are served in a smart receptacle, such as on a platter. At block 1306, a consumer tries an item. At block 1308, the consumer realizes a preference on the item, for example, strongly liking or strongly disliking the item. At block 1310 the consumer pairs a MID with the smart receptacle, and downloads information about the item, for example, along with comments and observations. At block 1312, a database is built of the user's preference, for example, on the MID. The database may include preferences by meal type, establishment, wine pairings, and the like. At block 1314, the consumer can use the history to aid purchase decisions, for example, by accessing the database on the MID.

The methods 1100, 1200, and 1300 allow the context of a consumer's preferences to be tracked in building the database. For example, a consumer's preferences can change depending on the environment, their companions, and so forth. The methods provide a database, for example, on a consumer's MID, that has learned the preferences in different contexts, particularly in situations where courses may be shared. For example, when dining with a first group the information contained in dishes ordered may indicate a preference for 'spicy', while for dining in a second group the preference may be for savory. This information may be determined by monitoring the dishes that are consumed first or are more frequently ordered. This learning capability can also be applied to determining preferences between establishments, for example, a beverage may be very desirable in one establishment and unsatisfactory in another. Similarly it can learn that when consuming in a particular establishment the consumer has a preference for certain drink or foodstuffs or styles.

The techniques may be used to allow easier payment for consumables. For example, the smart receptacle may be used to track credit and make the payments, decreasing the need to wait for interaction with a server.

Figure 14:
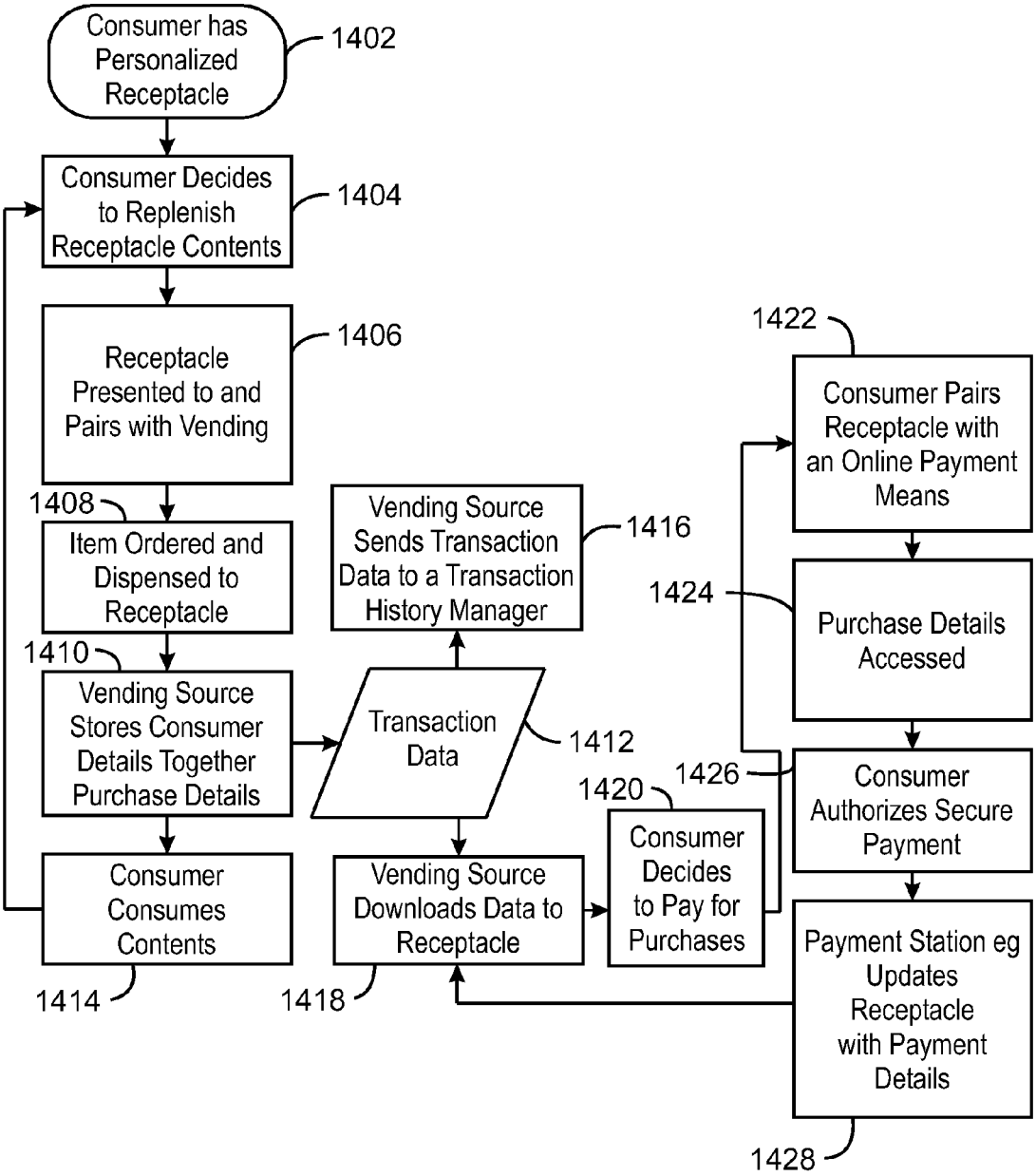
FIG. 14 is a process flow diagram of a method for quantity based consumption and payment enabled by smart receptacle technology.

FIG. 14 is a process flow diagram of a method 1400 for quantity based consumption and payment enabled by smart receptacle technology. smart receptacles can be used to monitor a user's consumption enabling a single payment. For example in a work environment the user may have a personal smart receptacle. The method starts at block 1402 with a consumer having a personalized smart receptacle, for example, a coffee cup. At block 1404, the consumer decides to purchase a drink. At block 1406, the smart receptacle is paired with an appropriate vending source, which may be an IoT enabled vending machine, or a personal server who has an IoT enabled device. The pairing may be through an optical link or a radio frequency link, as described herein.

At block 1408 the item is ordered and dispensed to the smart receptacle. The smart receptacle may be refilled without a point of sale (POS) payment on an IoT enabled vending machine which may download payment details to the device which can be stored. In other examples, the vending machine may download payment details to a monitoring system, for example, through the cloud, which stores the individual's consumption. The consumer may then pay by registering his smart receptacle with a payment station, or by registering a payment on-line. The payment information may be stored in the smart receptacle, allowing a certain number of refills. The smart receptacle may record quantity where cost is based on volume or weight, such as at salad bars which charge by weight, drink dispensers which charge different amounts for small, medium, or large sizes, and the like.

After dispensing the item, at block 1410, the vending source stores the transaction data 1412. At block 1414, the item is consumed. Process flow then returns to block 1404 for the consumer to replenish the smart receptacle.

At block 1416, the transaction data 1412 is sent to a transaction manager, for example, to maintain a history in event of receptacle failure or dispute, or to manage future transactions. The transaction data 1412 may also be downloaded to the smart receptacle at block 1418, allowing a payment cycle to begin.

At block 1420, the consumer decides to pay for the purchases. At block 1422 the consumer pairs the smart receptacle with an online payment system. For example, the consumer may pair the smart receptacle with a payment station, which may be a dedicated device or a MID enabled for secure payment. Further, the consumer may sign on to a website and authorize an on-line payment, which may be uploaded to the smart receptacle when it is later paired with a vending system. At block 1424, the purchase details may be accessed for a recent purchase, or for future credits. At block 1426, the consumer authorizes the payment. At block 1428, the payment station then updates or resets the payment history in the smart receptacle. The method 1400 may be useful in many types of environments, such as for short term use in a bar, or over a long period in an office.

Figure 15:
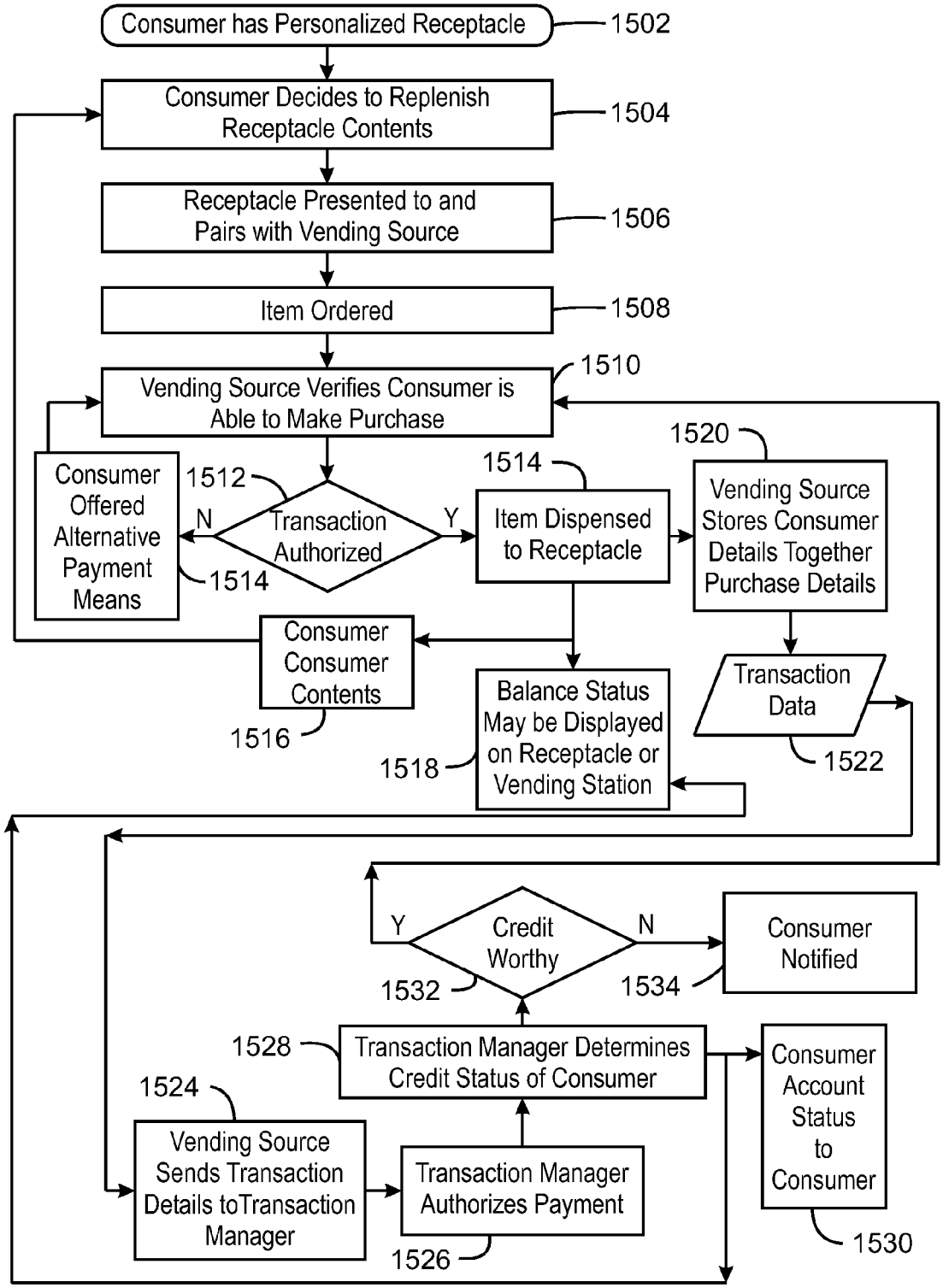
FIG. 15 is a process flow diagram of another method for quantity based consumption and payment enabled by smart receptacle technology.

FIG. 15 is a process flow diagram of another method for quantity based consumption and payment enabled by smart receptacle technology. In this method 1500, purchases are made against prepurchased credit. The method starts at block 1502 with a consumer having a personalized smart receptacle. At block 1504, the consumer decides to replenish the contents. At block 1506, the smart receptacle is paired with an appropriate vending source, which may be an IoT enabled vending machine, or a personal server who has an IoT enabled device. The pairing may be through an optical link or a radio frequency link, as described herein.

At block 1508, an item, such as a refill, is ordered. At block 1510, the vending source verifies that the consumer is able to make purchase, e.g., has sufficient funds, does not have outstanding payments, or hasn't exceeded preauthorized limits, among others. At block 1512, the transaction authorization is determined. If the transaction is not authorized, process flow proceeds to block 1514, at which the consumer is offered alternative means for payment, such as a downloaded credit card, a new credit card transaction, and the like. If the transaction is authorized at block 1512, at block 1514 the item is dispensed to the smart receptacle. At block 1516, the consumer consumes the contents, and process flow returns to block 1504. At block 1518, the smart receptacle or a vending station may display the balance remaining.

After dispensing the item, at block 1520, the vending source stores the transaction data 1522. At block 1524, the transaction data 1522 is sent to a transaction manager. At block 1526, the transaction manager authorizes payment. At block 1528, the transaction manager determines the credit status of the consumer. At block 1530, the account status is provided to the consumer, for example, through the smart receptacle or to an MID. If the transaction manager determines the consumer is credit worthy at block 1532, process flow returns to block 1510. If not, process flow proceeds to block 1534, at which the consumer is notified. The usage model described with respect to the method 1500 would also support purchases from multiple establishments and sources.

Figure 16:
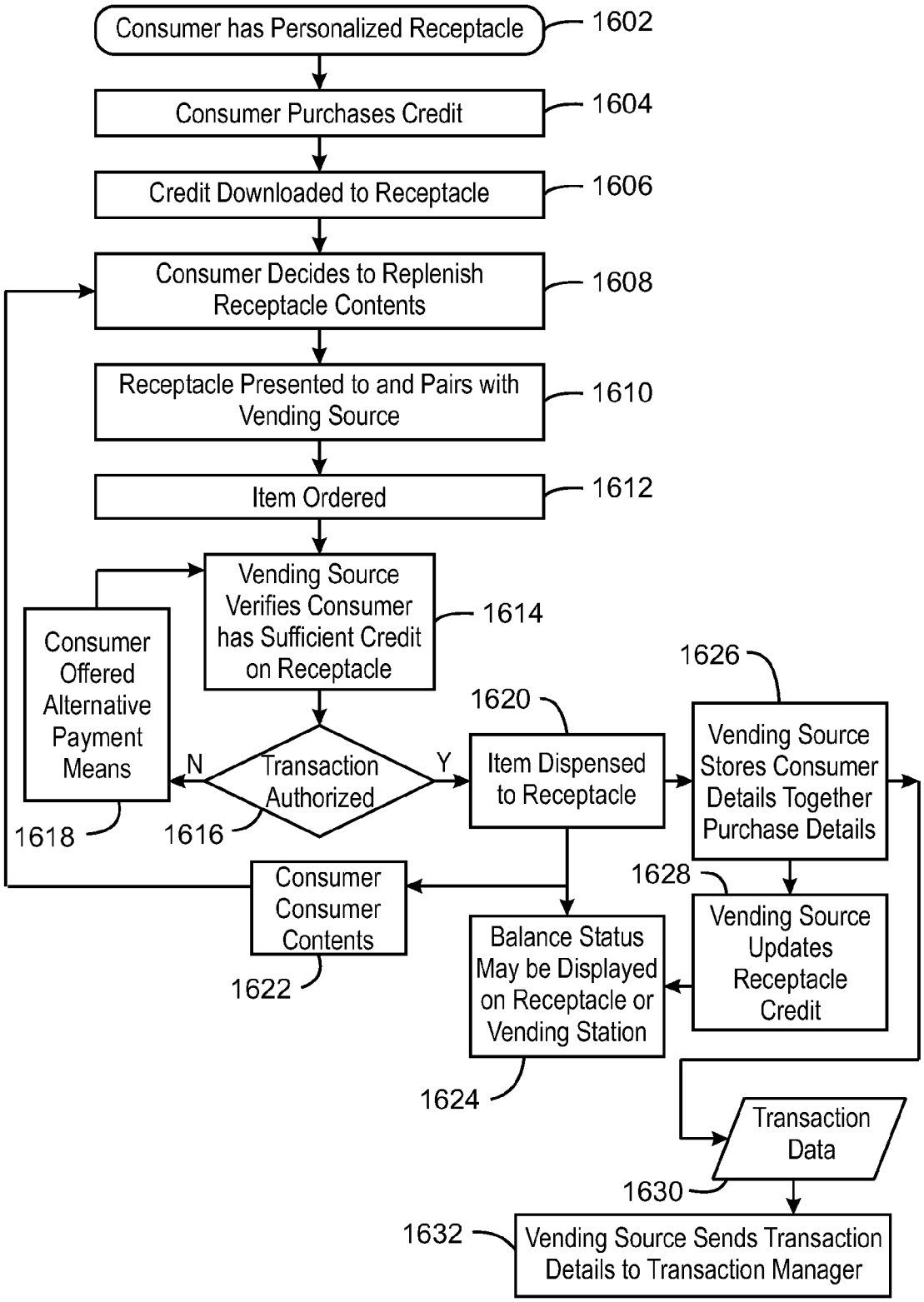
FIG. 16 is a process flow diagram of another method for quantity based consumption and payment enabled by smart receptacle technology.

FIG. 16 is a process flow diagram of another method 1600 for quantity based consumption and payment enabled by the smart receptacle technology. In this example, credits are purchased and downloaded to the smart receptacle before ordering, and each time a purchase is made the receptacle details are updated. As a security feature the transaction records may be sent to a transaction history manager. This approach may be desirable in situations where a consumer may wish to limit their consumption, e.g., a consumer may wish to limit alcohol consumption so preloads a beer glass with a limited number of refills.

The method starts at block 1602 with a consumer having a personalized smart receptacle. At block 1604, the consumer purchase credit for the smart receptacle. At block 1606, the credit is downloaded to the smart receptacle.

At block 1608, the consumer decides to replenish the contents of the smart receptacle. At block 1610, the smart receptacle is paired with an appropriate vending source, which may be an IoT enabled vending machine, or a personal server who has an IoT enabled device. The pairing may be through an optical link or a radio frequency link, as described herein.

At block 1612, an item, such as a refill, is ordered. At block 1614, the vending source verifies that the consumer has sufficient credit on the smart receptacle for the purchase. At block 1616, the transaction authorization is determined. If the transaction is not authorized, process flow proceeds to block 1618, at which the consumer is offered alternative means for payment, such as a downloaded credit card, a new credit card transaction, and the like. If the transaction is authorized at block 1616, at block 1620 the item is dispensed to the smart receptacle. At block 1622, the consumer consumes the contents, and process flow returns to block 1608. At block 1624, the smart receptacle or a vending station may display the balance remaining.

After dispensing the item, at block 1626, the vending source stores the transaction data 1630. At block 1628, the vending source updates the credit stored in the smart receptacle. At block 1632, the transaction data 1630 is sent to a transaction manager.

Figure 17:
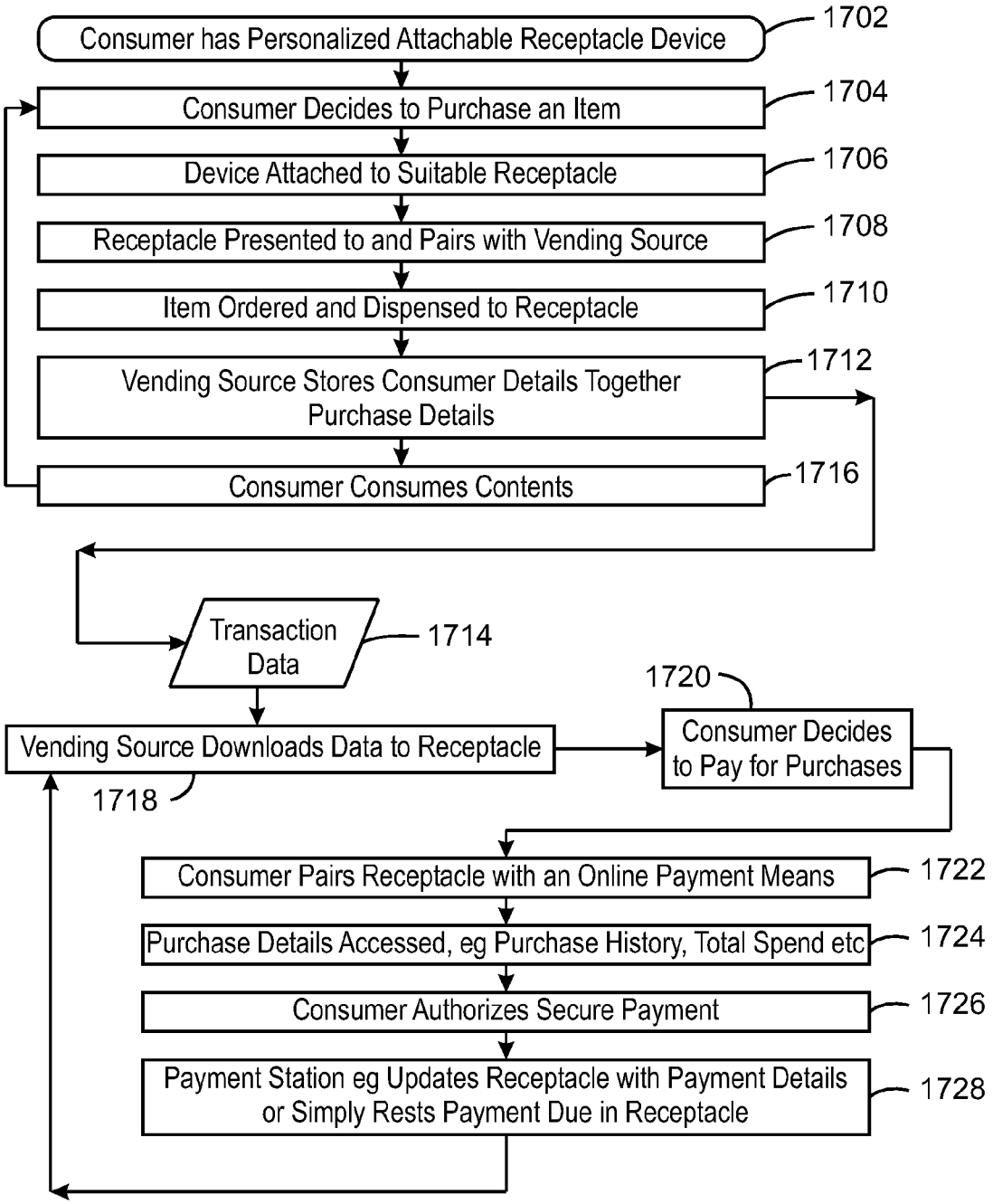
FIG. 17 is a process flow diagram of another method for quantity based consumption and payment enabled by smart receptacle technology.

FIG. 17 is a process flow diagram of another method for quantity based consumption and payment enabled by smart receptacle technology. The method starts at block 1702 with a consumer having a personalized smart device, such as the central core 202 of FIG. 2, which attaches to a container to form the smart receptacle. At block 1704, the consumer decides to purchase an item, such as a drink. At block 1706, the device is attached to the container. At block 1708, the smart receptacle is paired with an appropriate vending source, which may be an IoT enabled vending machine, or a personal server who has an IoT enabled device. The pairing may be through an optical link or a radio frequency link, as described herein.

At block 1710 the item is ordered and dispensed to the smart receptacle. The smart receptacle may be refilled without a point of sale (POS) payment on an IoT enabled vending machine which may download payment details to the device which can be stored. In other examples, the vending machine may download payment details to a monitoring system, for example, through the cloud, which stores the individual's consumption. The consumer may then pay by registering his smart receptacle with a payment station, or by registering a payment on-line. The payment information may be stored in the smart receptacle, allowing a certain number of refills. The smart receptacle may record quantity where cost is based on volume or weight, such as at salad bars which charge by weight, drink dispensers which charge different amounts for small, medium, or large sizes, and the like.

After dispensing the item, at block 1712, the vending source stores the transaction data 1714. At block 1716, the item is consumed. Process flow then returns to block 1704 for the consumer to replenish the smart receptacle.

At block 1718, the transaction data 1716 is downloaded to the smart receptacle, allowing a payment cycle to begin.

At block 1720, the consumer decides to pay for the purchases. At block 1722, the consumer pairs the smart receptacle with an online payment system. For example, the consumer may pair the smart receptacle with a payment station, which may be a dedicated device or a MID enabled for secure payment. Further, the consumer may sign on to a website and authorize an on-line payment, which may be uploaded to the smart receptacle when it is later paired with a vending system. At block 1724, the purchase details may be accessed for a recent purchase, or for future credits. At block 1726, the consumer authorizes the payment. At block 1728, the payment station then updates or rests the payment due in the smart receptacle. The method 1700 may be useful in many types of environments, such as for short term use in a bar, or over a long period in an office.

Figure 18:
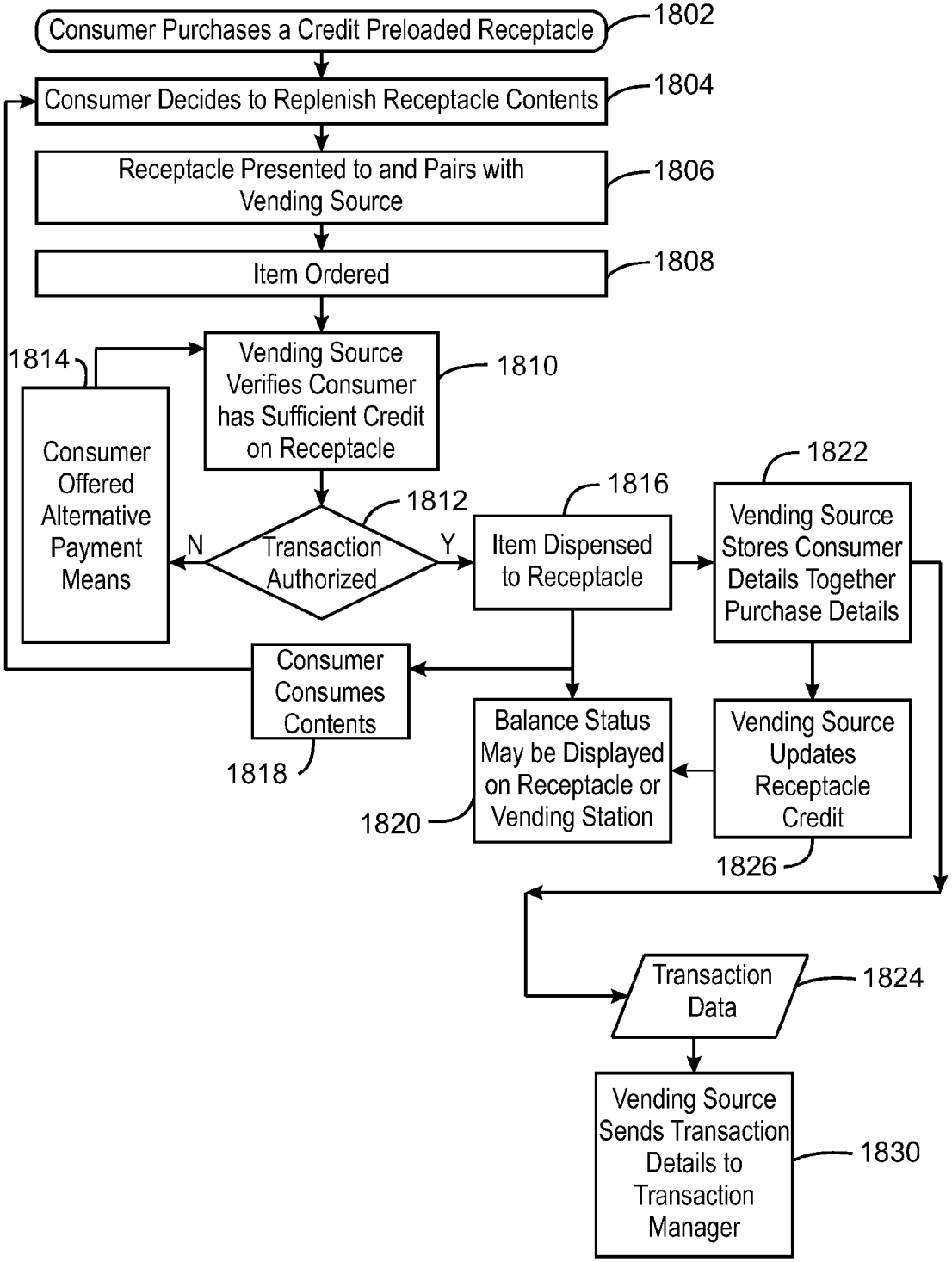
FIG. 18 is a process flow diagram of another method for quantity based consumption and payment enabled by smart receptacle technology.

FIG. 18 is a process flow diagram of another method for quantity based consumption and payment enabled by smart receptacle technology. In this example, a smart receptacle is preloaded with credits, and each time a purchase is made the receptacle details are updated.

The method starts at block 1802 when a consumer purchases a smart receptacle that has been preloaded with credits. At block 1804, the consumer decides to replenish the contents of the smart receptacle. At block 1806, the smart receptacle is paired with an appropriate vending source, which may be an IoT enabled vending machine, or a personal server who has an IoT enabled device. The pairing may be through an optical link or a radio frequency link, as described herein.

At block 1808, an item, such as a refill, is ordered. At block 1810, the vending source verifies that the consumer has sufficient credit on the smart receptacle for the purchase. At block 1812, the transaction authorization is determined. If the transaction is not authorized, process flow proceeds to block 1814, at which the consumer is offered alternative means for payment, such as a downloaded credit card, a new credit card transaction, and the like. If the transaction is authorized at block 1812, at block 1816 the item is dispensed to the smart receptacle. At block 1818, the consumer consumes the contents, and process flow returns to block 1804. At block 1820, the smart receptacle or a vending station may display the balance remaining.

After dispensing the item, at block 1822, the vending source stores the transaction data 1824. At block 1826, the vending source updates the credit stored in the smart receptacle. At block 1830, the transaction data 1824 is sent to a transaction manager.

The devices and techniques described herein may be personalized for use in a medical environment. This is similar to the method described with respect to FIG. 8. However, in this example, the patient is also issued a wearable device which personally identifies them, for example a wrist band.

Figure 19:
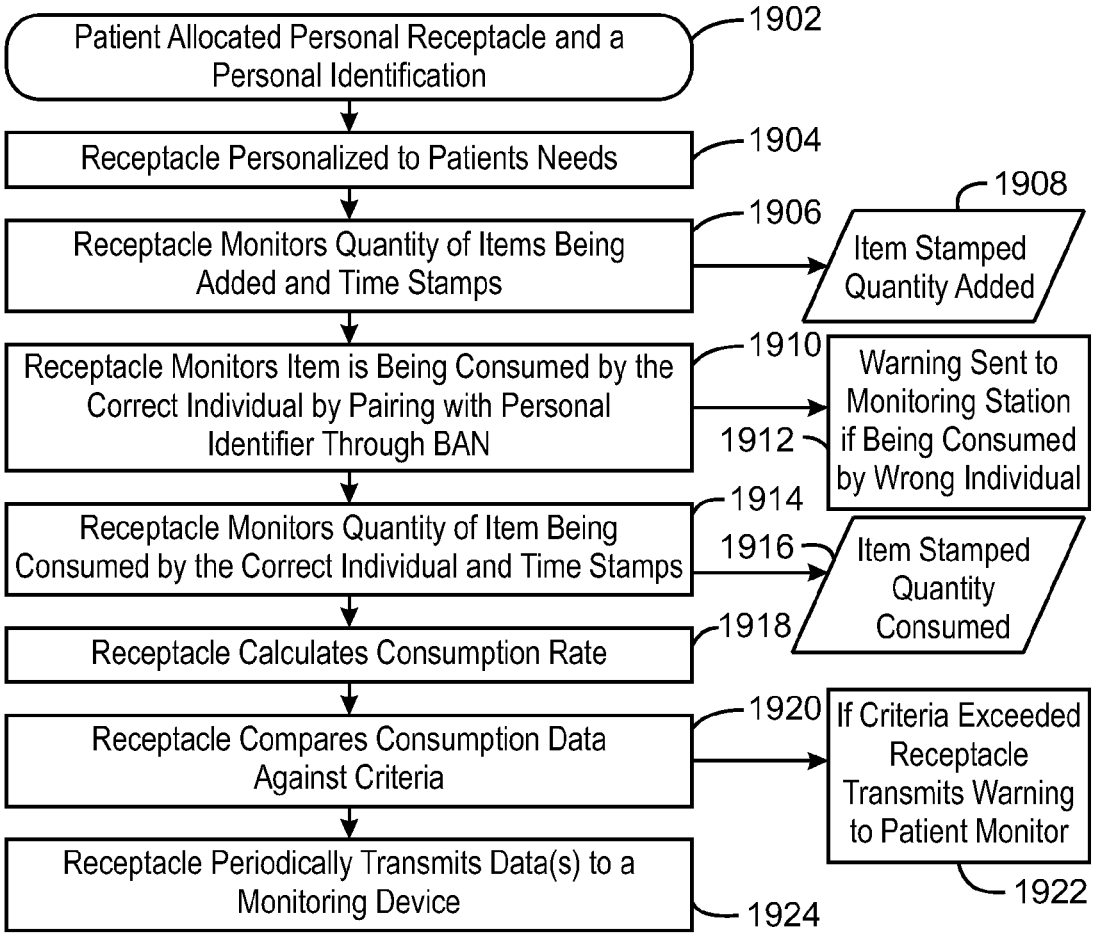
FIG. 19 is a process flow diagram of a personalized method for using smart receptacles to monitor consumption in a medical environment.

FIG. 19 is a process flow diagram of a personalized method 1900 for using smart receptacles to monitor consumption in a medical environment. The method 1900 begins at block 1902 when a patient is provided with a personalized smart receptacle and a personal identification device. For example, the smart receptacle may include a body coupled communication or similar body area network (BAN) capability to provide personalization and identification of the consumer. For example, a hospital patient may be uniquely identified by a wearable device which personally identifies the wearer and which communicates through the BAN.

At block 1904, the smart receptacle may be downloaded with information such as the target patient intake of the item. At block 1906, the smart receptacle monitors the quantity of the item added to the smart receptacle and records an item stamped quantity added 1908.

At block 1910, the smart receptacle confirms that the item is being consumed by the correct individual. If not, a warning 1912 is sent to a monitoring station. When the patient consumes liquid from the smart receptacle the smart receptacle may collaborate to identify that the content is being consumed by the correct individual. The smart receptacle may then identify that the wrong individual is consuming the item and generates a warning, either audible, visual or through an IoT enabled network.

At block 1914, the smart receptacle monitors the quantity consumed, and records the item stamped quantity added 1916 of any further materials added. While continuing to monitor consumption, at block 1918, the smart receptacle calculates a consumption rate. At block 1920, the smart receptacle compares the consumption rate, total amount, or other criteria against the target criteria. At block 1922, if the criteria are exceed, such as if the intake falls below a target level, a warning signal is provided to a patient monitor, e.g., nurse or other health care provider. At block 1924, the smart receptacle periodically transmits the consumption data to a monitoring device. The monitoring device may be an attachable device such as a cup holder, or may be a fixed device, such as a central monitor at a nurse's station. The method 1900 may be used in combination with the methods 900 and 1000 described with respect to FIGS. 9 and 10 to provide a complete monitoring of nourishment consumed by a patient. The personalization concept can be applied to any of the other example applications enabled by smart receptacle technology.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the inventions. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

Example 1 includes an apparatus for monitoring the consumption of foodstuffs, including a processor, a sensor to measure an amount of material in a smart receptacle, and a communications device to transmit the amount. The apparatus includes a storage device that holds instructions to direct the processor to measure the amount of material in the smart receptacle using the sensor and send the measured amount out using the communications device.

Example 2 incorporates the subject matter of Example 1. In this example, the apparatus includes a smart receptacle for liquids, a cup, or a glass.

Example 3 incorporates the subject matter of any combination of Examples 1-2. In this example, the apparatus includes a smart receptacle for solid foods, a plate, a basket, or a platter.

Example 4 incorporates the subject matter of any combination of Examples 1-3. In this example, a device may be attached to the smart receptacle, wherein the device includes the processor, the sensor to measure an amount of material in the smart receptacle, and the communications device to transmit the amount.

Example 5 incorporates the subject matter of any combination of Examples 1-4. In this example, the device includes the storage device that holds the instructions to direct the processor to measure the amount of material in the smart receptacle using the sensor and send the measured amount out using the communications device.

Example 6 incorporates the subject matter of any combination of Examples 1-5. In this example, the device is hermetically sealed.

Example 7 incorporates the subject matter of any combination of Examples 1-6. In this example, the device includes a battery, wherein the battery is built into the device.

Example 8 incorporates the subject matter of any combination of Examples 1-7. In this example, the apparatus includes a display device on the smart receptacle. The apparatus may include a visible beacon, an auditory alarm, or both.

Example 9 incorporates the subject matter of any combination of Examples 1-8. In this example, the apparatus includes a radio communications device.

Example 10 incorporates the subject matter of any combination of Examples 1-9. In this example, the radio communications device includes a Wi-Fi device, a Bluetooth® device, a low energy Bluetooth® device, a radio network device, or any combinations thereof.

Example 11 provides a method for monitoring the consumption of materials, including determining the presence of materials in a smart receptacle using a sensor located in the smart receptacle. A server is alerted when an actionable item is detected.

Example 12 incorporates the subject matter of Example 11. In this example, the method includes measuring an amount in the smart receptacle, and sending the amount to a central device.

Example 13 incorporates the subject matter of any combination of Examples 11-12. In this example, the method includes locating a smart receptacle by triangulation.

Example 14 incorporates the subject matter of any combination of Examples 11-13. In this example, the method includes establishing an ad hoc network between a plurality of smart receptacles.

Example 15 incorporates the subject matter of any combination of Examples 11-14. In this example, the location is determined for each of the plurality of smart receptacles by mapping a number of hops for each message in the ad hoc network to reach each of the plurality of smart receptacles.

Example 16 incorporates the subject matter of any combination of Examples 11-15. In this example, the method includes measuring an amount of liquid in an outflow smart receptacle, wherein the outflow smart receptacle includes a urine bag, a surgical drainage unit, or a liquid collection device and sending the amount of liquid in the outflow smart receptacle to the central device.

Example 17 incorporates the subject matter of any combination of Examples 11-16. In this example, the method includes calculating a net amount of liquid intake for a patient.

Example 18 incorporates the subject matter of any combination of Examples 11-17. In this example, the method includes measuring the amount with a pressure sensor.

Example 19 incorporates the subject matter of any combination of Examples 11-18. In this example, the amount is sent through a wireless network, an optical transmission, or both.

Example 20 incorporates the subject matter of any combination of Examples 11-19. In this example, a server is informed of the location of the smart receptacle.

Example 21 incorporates the subject matter of any combination of Examples 11-20. In this example, a server is alerted when the smart receptacle is substantially empty.

Example 22 incorporates the subject matter of any combination of Examples 11-21. In this example, a beacon in the smart receptacle is flashed when the smart receptacle is substantially empty.

Example 23 incorporates the subject matter of any combination of Examples 11-22. In this example, nutritional information is downloaded to the smart receptacle and transferred from the smart receptacle to a mobile internet device (MID).

Example 24 incorporates the subject matter of any combination of Examples 11-23. In this example, allergen information is downloaded to the smart receptacle, compared to allergen information in a MID, and the consumer is alerted if an allergen match is detected.

Example 25 incorporates the subject matter of any combination of Examples 11-24. In this example, the method includes monitoring a quantity of foodstuffs consumed by a patient by tracking quantity of item added at a particular time, tracking quantity consumed at a particular time, and periodically transmitting an amount consumed to a monitoring device.

Example 26 incorporates the subject matter of any combination of Examples 11-25. In this example, product information is downloaded to the smart receptacle, and the smart receptacle linked to a mobile internet device to allow the product information to be downloaded.

Example 27 incorporates the subject matter of any combination of Examples 11-26. In this example, the method includes tracking consumption by a customer and developing a database of preferences for the customer.

Example 28 incorporates the subject matter of any combination of Examples 11-27. In this example, the consumption of each of a group of customers is correlated and a database of preferences for the group of customers is developed.

Example 29 incorporates the subject matter of any combination of Examples 11-28. In this example, the method includes pairing a smart receptacle with an electronic payment system, tracking consumption from the smart receptacle, and paying from electronic payment system.

Example 30 incorporates the subject matter of any combination of Examples 11-29. In this example, a customer's smart receptacle may be paired with a dispensing system, and filling of the customer's smart receptacle is ordered.

Example 31 incorporates the subject matter of any combination of Examples 11-30. In this example, the method includes confirming that credit is sufficient for the purchase and filling of the smart receptacle is authorized.

Example 32 incorporates the subject matter of any combination of Examples 11-31. In this example, a balance is displayed on the smart receptacle.

Example 33 incorporates the subject matter of any combination of Examples 11-32. In this example, a number of credits are downloaded to a smart receptacle.

Example 34 incorporates the subject matter of any combination of Examples 11-33. In this example, a payment due is stored in the smart receptacle.

Example 34 incorporates the subject matter of any combination of Examples 11-33. In this example, the smart receptacle is linked to a patient identifier through a body area network (BAN) and medical personnel are warned if a different person consumes a material.

Example 35 includes a non-transitory, machine readable medium. The medium includes instructions to direct a processor to monitor a sensor located on a smart receptacle and alert a server when an actionable item is detected.

Example 36 incorporates the subject matter of Example 35. In this example, the non-transitory, machine readable medium includes instructions to direct a processor to communicate with a central device.

Example 37 incorporates the subject matter of any combination of Examples 35-36. In this example, the non-transitory, machine readable medium includes instructions to direct the processor to establish an ad hoc network between a number of smart receptacles.

Example 38 incorporates the subject matter of any combination of Examples 35-37. In this example, the non-transitory, machine readable medium includes instructions to direct the processor to send a location for a smart receptacle to a central device.

Example 39 incorporates the subject matter of any combination of Examples 35-38. In this example, the non-transitory, machine readable medium includes instructions to direct the processor to alert a server when the smart receptacle is substantially empty.

Example 40 incorporates the subject matter of any combination of Examples 35-39. In this example, the non-transitory, machine readable medium includes instructions to direct the processor to flash a light in the smart receptacle when the smart receptacle is substantially empty.

Example 41 incorporates the subject matter of any combination of Examples 35-40. In this example, the non-transitory, machine readable medium includes instructions to direct the processor to download nutritional information to the smart receptacle and transfer the nutritional information from the smart receptacle to a mobile internet device (MID).

Example 42 incorporates the subject matter of any combination of Examples 35-41. In this example, the non-transitory, machine readable medium includes instructions to direct the processor to download allergen information to the smart receptacle, compare the allergen information from the smart receptacle to allergen information in a MID, and alert a consumer if an allergen match is detected.

Example 43 incorporates the subject matter of any combination of Examples 35-42. In this example, the non-transitory, machine readable medium includes instructions to direct the processor to monitor a quantity of foodstuffs consumed by a patient, by tracking a quantity of an item added at a particular time, tracking a quantity of the item consumed at a particular time, and periodically transmitting the amount consumed to a monitoring device.

Example 44 incorporates the subject matter of any combination of Examples 35-43. In this example, the non-transitory, machine readable medium includes instructions to direct the processor to download product information to the smart receptacle, and link the smart receptacle to a mobile internet device (MID) to allow the product information to be downloaded to the MID.

Example 45 incorporates the subject matter of any combination of Examples 35-44. In this example, the non-transitory, machine readable medium includes instructions to direct the processor to pair the smart receptacle with an electronic payment system, track consumption from smart receptacle, and pay from the electronic payment system.

Example 46 incorporates the subject matter of any combination of Examples 35-45. In this example, the non-transitory, machine readable medium includes instructions to direct the processor to pair a smart receptacle with a local system, confirm that credit is sufficient for a purchase, and authorize a filling of smart receptacle.

Example 47 incorporates the subject matter of any combination of Examples 35-46. In this example, the non-transitory, machine readable medium includes instructions to direct the processor to display a balance on the smart receptacle.

Example 48 incorporates the subject matter of any combination of Examples 35-47. In this example, the non-transitory, machine readable medium includes instructions to direct the processor to download a number of credits to a smart receptacle.

Example 49 incorporates the subject matter of any combination of Examples 35-48. In this example, the non-transitory, machine readable medium includes instructions to direct the processor to store a payment due in the smart receptacle.

Example 50 incorporates the subject matter of any combination of Examples 35-49. In this example, the non-transitory, machine readable medium includes instructions to direct a processor to link the smart receptacle to a patient identifier through a body area network (BAN) and warn medical personnel if a different person consumes contents of the smart receptacle.

Example 51 provides a non-transitory, machine readable medium that includes instructions to direct a processor to receive an amount consumed from a smart receptacle for foodstuffs, and alert a server when an actionable threshold is detected. Instructions may be included to direct the processor to establish an ad hoc network between a number of smart receptacles.

Example 52 incorporates the subject matter of Example 51. In this example, the non-transitory, machine readable medium includes instructions to direct the processor to create a map of smart receptacles and determine a location for a smart receptacle by mapping a number of hops for each message in the ad hoc network to reach a destination.

Example 53 incorporates the subject matter of any combination of Examples 51-52. In this example, the non-transitory, machine readable medium includes instructions to direct the processor to locate a smart receptacle by triangulation.

Example 54 incorporates the subject matter of any combination of Examples 51-53. In this example, the non-transitory, machine readable medium includes instructions to direct the processor to inform the server of the location of the smart receptacle.

Example 55 incorporates the subject matter of any combination of Examples 51-54. In this example, the non-transitory, machine readable medium includes instructions to direct the processor to alert a server when the smart receptacle is substantially empty.

Example 56 incorporates the subject matter of any combination of Examples 51-55. In this example, the non-transitory, machine readable medium includes instructions to direct the processor to track consumption by a customer and develop a database of preferences for the customer.

Example 57 incorporates the subject matter of any combination of Examples 51-56. In this example, the non-transitory, machine readable medium includes instructions to direct the processor to correlate consumption of each of a group of customers and develop a database of preferences for the group of customers.

Example 58 includes an establishment that serves consumable items. The establishment includes a number of smart receptacles, wherein each smart receptacle includes a processor, a sensor to detect material in the smart receptacle, a communications device to transmit the result of the detection, and a storage device including instructions to direct the processor to detect material in the smart receptacle using the sensor and send a result of the detection using the communications device. The establishment also includes a central device that includes a communications device to receive the result and an alerting device to inform a server when an actionable threshold has been crossed.

The establishment may include an ad hoc network. Remote devices may inform servers that service is needed. The central device may include an internet connection to process payment information, database accesses, alerts, or any combinations thereof.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. An apparatus for monitoring the consumption of foodstuffs, comprising:

a processor;

a sensor to measure an amount of a material in a smart receptacle;

a communications device to transmit the amount;

a storage device to store received composition parameters about the material in the smart receptacle;

the storage device comprising instructions to direct the processor to:

measure the amount of the material in the smart receptacle using the sensor; and send the measured amount and the received composition parameters about the material out using the communications device.

2. The apparatus of claim 1, comprising a smart receptacle for liquids, a cup, or a glass.

3. The apparatus of claim 1, comprising a smart receptacle for solid foods, a plate, a basket, or a platter.

4. The apparatus of claim 1, comprising a device attached to the smart receptacle, wherein the device comprises:

the processor;

the sensor to measure an amount of the material in the smart receptacle;

the communications device to transmit the amount;

the storage device comprising instructions to direct the processor to:

measure the amount of the material in the smart receptacle using the sensor; and send the measured amount out using the communications device.

5. The apparatus of claim 4, wherein the device is hermetically sealed.

6. The apparatus of claim 1, comprising a display device on the smart receptacle.

7. The apparatus of claim 1, comprising a visible beacon, an auditory alarm, or both.

8. The apparatus of claim 1, comprising a radio communications device.

9. The apparatus of claim 8, wherein the radio communications device comprises a WiFi device, a Bluetooth device, a low energy Bluetooth device, a radio network device, or any combinations thereof.

10. The apparatus of claim 1, wherein:

the composition parameters comprise allergen risk information; and the received composition parameters about the material is sent out to a consumer mobile internet device.

11. The apparatus of claim 1, wherein the apparatus is associated with a single consumer and the material provided to the apparatus is altered to match a preference of the consumer.

12. The apparatus of claim 1, wherein the storage device stores credits associated with the apparatus.

13. A method for monitoring the consumption of materials, comprising:

determining the presence of materials in a smart receptacle using a sensor located in the smart receptacle; and alerting a consumer mobile internet device when an actionable item is detected.

14. The method of claim 13, comprising locating a smart receptacle by triangulation.

15. The method of claim 13, comprising establishing an ad hoc network between a plurality of smart receptacles.

16. The method of claim 15, comprising determining a location for each of the plurality of smart receptacles by mapping a number of hops for each message in the ad hoc network to reach each of the plurality of smart receptacles.

17. The method of claim 13, comprising:

measuring an amount of liquid in an outflow smart receptacle, wherein the outflow smart receptacle includes a urine bag, a surgical drainage unit, or a liquid collection device; and sending the amount of liquid in the outflow smart receptacle to a central device.

18. The method of claim 17, comprising calculating a net amount of liquid intake for a patient.

19. The method of claim 13, comprising measuring the amount with a pressure sensor.

20. A non-transitory, machine readable medium, comprising instructions to direct a processor to:

monitor a sensor located on a smart receptacle; and alert a consumer mobile internet device when an actionable item is detected.

21. The non-transitory, machine readable medium of claim 20, comprising instructions to direct the processor to establish an ad hoc network between a plurality of smart receptacles.

22. The non-transitory, machine readable medium of claim 20, comprising instructions to direct the processor to send a location for a smart receptacle to a central location.

23. The non-transitory, machine readable medium of claim 20, comprising instructions to direct the processor to alert a server when the smart receptacle is substantially empty.

24. An establishment that serves consumable items, comprising:

a plurality of smart receptacles, wherein each smart receptacle comprises:

a processor;

a sensor to detect material in the smart receptacle;

a communications device to transmit the result of the detection;

a storage device comprising instructions to direct the processor to:

detect material in the smart receptacle using the sensor; and send a result of the detection using the communications device to a consumer mobile internet device and a central device; and the central device, comprising:

a communications device to receive the result; and an alerting device to inform a server when an actionable threshold has been crossed.

25. The establishment of claim 24, wherein the central device comprises an internet connection to process payment information, database accesses, alerts, or any combinations thereof.

* * * * *